US009579547B2

(12) United States Patent
Mizutani

(10) Patent No.: US 9,579,547 B2
(45) Date of Patent: Feb. 28, 2017

(54) GOLF CLUB

(71) Applicant: DUNLOP SPORTS CO. LTD., Kobe-shi, Hyogo (JP)

(72) Inventor: Naruhiro Mizutani, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/742,366

(22) Filed: Jun. 17, 2015

(65) Prior Publication Data

US 2015/0367187 A1 Dec. 24, 2015

(30) Foreign Application Priority Data

Jun. 18, 2014 (JP) ..... 2014-125337
Jun. 30, 2014 (JP) ..... 2014-134790

(51) Int. Cl.
*A63B 53/02* (2015.01)
*A63B 53/04* (2015.01)

(52) U.S. Cl.
CPC ..... *A63B 53/02* (2013.01); *A63B 53/047* (2013.01); *A63B 60/28* (2015.10); *A63B 60/16* (2015.10); *A63B 2053/022* (2013.01); *A63B 2209/00* (2013.01); *A63B 2225/09* (2013.01)

(58) Field of Classification Search
CPC ..... A63B 53/02; A63B 2053/022; A63B 2209/00; A63B 2225/09; A63B 53/047; A63B 60/16; A63B 60/28
See application file for complete search history.

(56) References Cited

U.S. PATENT DOCUMENTS 8,562,453 B2 * 10/2013 Sato ..... A63B 53/02 473/288
8,636,606 B2 * 1/2014 Sato ..... A63B 53/02 473/248
2004/0018887 A1 * 1/2004 Burrows ..... A63B 53/02 473/307
2006/0264266 A1 * 11/2006 Jung ..... A63B 53/00 473/282
2010/0160071 A1 * 6/2010 Burrows ..... A63B 53/02 473/307

(Continued)

FOREIGN PATENT DOCUMENTS

JP 5447141 B2 3/2014

*Primary Examiner* — Stephen Blau
(74) *Attorney, Agent, or Firm* — Birch, Stewart, Kolasch & Birch, LLP

(57) ABSTRACT

A golf club includes a shaft, a golf club head including a hosel having an aperture to which the shaft being secured, a securing member configured in a cylindrical shape to cover the shaft, the securing member including a first securing portion detachably fitted to the aperture of the hosel, and an insert member configured in a cylindrical shape to cover the shaft, the insert member including a second securing portion being detachably attachable to the aperture of the hosel and a third securing portion being detachably attachable to the first securing portion of the securing member. The golf club is capable of adopting a first mode of securing the first securing portion to the hosel, and a second mode of securing the insert member to the hosel and securing the first securing portion to the third securing portion of the insert member.

6 Claims, 22 Drawing Sheets

(56) References Cited

U.S. PATENT DOCUMENTS

| | | | | |
|---|---|---|---|---|
| 2011/0111881 | A1* | 5/2011 | Sander | A63B 53/02<br>473/307 |
| 2011/0250984 | A1 | 10/2011 | Sato | |
| 2011/0263348 | A1 | 10/2011 | Sato | |

* cited by examiner

GOLF CLUB

CROSS REFERENCE

This application claims priorities to Japanese Patent Applications No. 2014-125337 filed on Jun. 18, 2014, and No. 2014-134790 filed on Jun. 30, 2014, which are hereby incorporated by reference in their entirety.

FIELD

The present invention relates to a golf club.

BACKGROUND

Over the recent years, golf clubs capable of replacing shafts have been proposed in response to user's requests. The shaft is replaced for varying a flexure by replacement with another shaft having different hardness. However, when replacing the shaft itself for varying the flexure, there arises a problem of increasing a cost. Such being the case, there is proposed a golf club (the publication of Japanese Patent No. 5447141) capable of varying the hardness without replacing the shaft.

To be specific, this golf club is configured to enable adoption of a first mode of fitting the shaft directly to a hosel of a golf club head, and a second mode of fitting the haft after increasing a length of the hosel (which will hereinafter be termed also the "hosel length") by fitting a cylindrical extension member to an aperture of the hosel. With this configuration, the hosel length can be varied, and hence deflectability of a front end of the shaft can be varied without changing the shaft itself.

SUMMARY

The golf club described above is, however, required to remove the shaft from the golf club head when fining the extension member, and therefore has a problem of an operation being complicated. Further, in the golf club described above, the deflectability of the shaft is varied by extending the hosel toward a shaft end from an upper end of the hosel of a head body while fitting the extension member. Consequently, this configuration leads to an increased length of a portion (which will hereinafter be referred to also as a "neck") to join the shaft and the head together to a degree corresponding to a length of the extension member in an upward area from the upper end of the hosel of the head body, resulting in a problem that a variation of the neck length causes a user to have a feeling of discomfort.

A first golf club according to the present invention includes a shaft, a golf club head including a hosel having an aperture to which a front end portion of the shaft being secured, a securing member configured in a cylindrical shape to cover an outer peripheral surface of the shaft, the securing member including a first securing portion detachably fitted to a peripheral edge of the aperture of the hosel and an insert member configured in a cylindrical shape to cover the outer peripheral surface of the shaft, the insert member including a second securing portion being detachably attachable to the peripheral edge of the aperture of the hosel and a third securing portion being detachably attachable to the first securing portion of the securing member. The golf club is capable of adopting a first mode of securing the first securing portion of the securing member to the hosel, and a second mode of securing the second securing portion of the insert member to the hosel and securing the first securing portion of the securing member to the third securing portion of the insert member.

The first golf club according to the present invention includes the securing member fitted to the peripheral edge of the aperture of the hosel and the insert member that can be disposed between the aperture of the hosel and the securing member. The length of the hosel can be therefore varied. In other words, it is possible to selectively adopt the first mode of securing the securing member to the aperture of the hosel, and the second mode of securing the insert member to the hosel and further securing the securing member to the insert member. The hosel length can be therefore varied in response to the user's request. On this occasion, handling is facilitated because the hosel length can be varied simply by attaching and detaching the securing member and the insert member.

In the golf club, the insert member may be configured to enable adoption of a cylindrical state of covering the outer peripheral surface of the shaft and a split state of splitting the insert member into a plurality of insert segments in a peripheral direction to separate from the outer peripheral surface of the shaft.

In any of the golf clubs described above, the securing member may be configured to be movable in an axial direction of the shaft, and the second mode may be adopted by disposing the insert member between the peripheral edge of the aperture of the hosel and the securing member after moving the securing member in the axial direction along the shaft from the first mode.

In any of the golf clubs described above, a male thread may be formed on an outer peripheral edge of the aperture of the hosel, the first securing portion of the securing member may be formed with a female thread to be screwed to the male thread of the aperture of the hosel, the second securing portion of the insert member may be formed with a female thread to be screwed to the male thread of the aperture of the hosel, and the third securing portion of the insert member may be formed with a male thread to be screwed to the female thread of the first securing portion of the securing member.

In any of the golf clubs described above, an outer peripheral edge of the aperture of the hosel may be formed with a male thread, and the first securing portion of the securing member may include a female thread to be screwed to the male thread of the aperture of the hosel and an engaging portion to engage with an inner peripheral edge of the aperture of the hosel, the engaging portion being formed inward in a radial direction of the female thread.

In any of the golf clubs described above, the insert member may be composed of a metal, a resin or particularly FRP (Fiber Reinforced Plastics).

A second golf club according to the present invention includes a shaft, a golf club head including a hosel having an aperture to which a front end portion of the shaft is secured, a securing member configured in a cylindrical shape to cover an outer peripheral surface of the shaft, the securing member including a first securing portion at one end portion in an axial direction and a plurality of insert members configured in a cylindrical shape to cover the outer peripheral surface of the shaft, each of the plurality of the insert members having a different axis-directional length and including a second securing portion being detachably attachable to the peripheral edge of the aperture of the hosel and a third securing portion being detachably attachable to the first first securing portion of the securing member. The golf club is configured such that one of the plurality of insert members is selectively fitted to the shaft to enable a variation of a length from the aperture of the hosel to the securing member.

In any of the golf clubs described above, the insert member may be configured to enable adoption of the cylindrical state of covering the outer peripheral surface of the shaft and the split state of splitting the insert member into the plurality of insert segments in the peripheral direction to separate from the outer peripheral surface of the shaft.

In any of the golf clubs described above, the securing member may be configured to be movable in the axial direction of the shaft.

A third golf club according to the present invention includes a shaft including a front end portion and a rear end portion, a golf club head including a hosel having an aperture to fit the shaft, a first adjusting mechanism including a shaft securing member disposed in an internal space of the hosel, the front end portion of the shaft being secured to the shaft securing member, an engaging member configured to enable engagement with the aperture of the hosel and taking a cylindrical shape to cover an outer peripheral surface of the shaft, and an insert member formed in a cylindrical shape to cover the outer peripheral surface of the shaft and enabled to be disposed between the shaft securing member and the engaging member, the first adjusting mechanism being configured to enable an adjustment of an axis-directional length to restrict the shaft based on the insert member, and a second adjusting mechanism including an extension member provided in continuation to the rear end portion of the shaft and detachably attachable to the rear end portion of the shaft, the second adjusting mechanism being configured to enable an adjustment of an axis-directional length of the shaft based on the extension member, and being further configured to enable an increase and a decrease of the axis-directional length of the shaft to such a degree that the first adjusting mechanism increases and decreases the axis-directional length to restrict the front end portion of the shaft.

In the golf club according to the configuration described above, the first adjusting mechanism adjusts the axis-directional length to restrict the front end portion of the shaft. Concretely, the golf club is configured such that the insert member can be disposed between the engaging member to engage with the aperture of the hosel of the golf club head and the securing member to secure the front end portion of the shaft. Hence, the golf club according to the configuration described above is capable of varying a depth at which the shaft is inserted into the hosel by attaching and detaching the insert member or by an exchange between the insert members having different lengths without changing a positional relation between the aperture of the hosel and the engaging member.

In other words, the positional relation between the aperture of the hosel and the engaging member does not change by attaching and detaching the insert member or by the exchange between the insert members having different lengths, resulting in no variation of the neck length. On the other hand, the depth at which the shaft is inserted into the hosel can be varied by attaching and detaching the insert member or by the exchange between the insert members having different lengths. It is therefore feasible to vary the length of the restricted portion at the front end portion of the shaft. The length of the restricted portion at the front end portion of the shaft corresponds to a length of a portion not causing the flexure at the front end portion of the shaft. The third golf club according to the present invention can therefore vary the deflectability of the shaft without varying the neck length.

However, upon a variation of the insert depth of the shaft into the hosel by the first adjusting mechanism, a length from the grip end to the golf club head (which will hereinafter be also termed a "club length") also varies. The variation of the club length has a possibility of causing the user to have the feeling of discomfort. This being the case, the golf club according to the configuration described above includes the second adjusting mechanism capable of increasing and decreasing the axis-directional length of the shaft to a degree corresponding the increase and the decrease of the insertion depth of the shaft into the hosel by the first adjusting mechanism. The second adjusting mechanism can keep constant the club length, and hence it is possible to provide the golf club enabled to vary the deflectability of the shaft without causing the user to have the feeling of discomfort.

By way of another mode of the golf club according to one aspect, an axis-directional length of the extension member may be set corresponding to an axis-directional length of the insert member, the first adjusting mechanism may be configured to be enabled to adopt a first mode of fitting the engaging member to the shaft securing member, and a second mode of disposing the insert member between the shaft securing member and the engaging member, and the second adjusting mechanism may be configured to be enabled to adopt a first mode of removing the extension member from the rear end portion of the shaft, and a second mode of fitting the extension member to the rear end portion of the shaft.

By way of still another mode of the golf club according to one aspect, the second adjusting mechanism may include a plurality of extension members having different axis-directional lengths, and a difference between the axis-directional lengths of the plurality of extension members may be set corresponding to the axis-directional length of the insert member. Further, the first adjusting mechanism may be configured to be enabled to adopt the first mode of fitting the engaging member to the shaft securing member, and the second mode of disposing the insert member between the shaft securing member and the engaging member, and the second adjusting mechanism may be configured to enable an adjustment of the axis-directional length of the shaft by selectively fitting one of the plurality of extension members to the rear end portion of the shaft.

By way of yet another mode of the golf club according to one aspect, the first adjusting mechanism may include a plurality of insert members having different axis-directional lengths, and the axis-directional length of the extension member may be set corresponding to a difference between the axis-directional lengths of the plurality of insert members. Further, the first adjusting mechanism may be configured to enable an adjustment of the axis-directional length to restrict the shaft by selectively disposing one of the plurality of insert members between the shaft securing member and the engaging member, and the second adjusting mechanism may be configured to be enabled to adopt the first mode of removing the extension member from the rear end portion of the shaft, and the second mode of fitting the extension member to the rear end portion of the shaft.

By way of yet yet another mode of the golf club according to one aspect, the first adjusting mechanism may include a plurality of insert members having different axis-directional lengths, and the second adjusting mechanism may include a plurality of extension members having different axis-directional lengths. Further, a different between the axis-directional lengths of the plurality of extension members may be set corresponding to a difference between the axis-directional lengths of the plurality of insert members. Furthermore, the first adjusting mechanism may be configured to enable an adjustment of the axis-directional length to restrict the shaft by selectively disposing one of the plurality of insert members between the shaft securing member and the engaging member, and the second adjusting mechanism may be configured to enable an adjustment of the axis-directional length of the shaft by selectively fitting one of the plurality of extension members to the rear end portion of the shaft.

By way of a further mode of the golf club according to one aspect, the rear end portion of the shaft may be provided with a recessed portion opening on the side of the rear end portion thereof, and one end portion of the extension member may be provided with a protruded portion formed to enable to fit in the recessed portion.

By way of a still further mode of the golf club according to one aspect, the shaft may include a hollowed portion opening on the side of the rear end portion thereof, and the rear end portion of the shaft may be provided an external annular wall surrounding the hollowed portion from outward in the radial direction. Moreover, one end portion of the extension member may be provided with an external annular portion formed to enable to fit on the external wall from outward in the radial direction, and an internal annular portion disposed inward in the radial direction of the external annular portion and enabled to be inserted into the hollowed portion of the shaft.

Note that the insert member may be configured to enable adoption of a cylindrical state of covering an outer peripheral surface of the shaft and a split state of being split in a peripheral direction and separated from the outer peripheral surface of the shaft. The engaging member may also be configured to be movable in the axial direction of the shaft. Then, the second mode may be adopted by disposing the insert member between the shaft securing member and the engaging member after the engaging member moves in the axial direction along the shaft from the first mode.

DESCRIPTION OF EMBODIMENT

An embodiment (which will hereinafter be referred to also as "the present embodiment") according to one aspect of the present invention will hereinafter be described with reference to the accompanying drawings. However, the present embodiment, which will be discussed below, is merely an exemplification of the present invention in every respect. A variety of improvements and modifications may be made without deviating from the scope of the present invention. In other words, a specific configuration corresponding to the embodiment may be properly adopted upon carrying out the present invention. Note that the description will be made based on directions on planes of the drawings for the convenience of explanation in the following discussion.

A. First Embodiment

Figure 1:
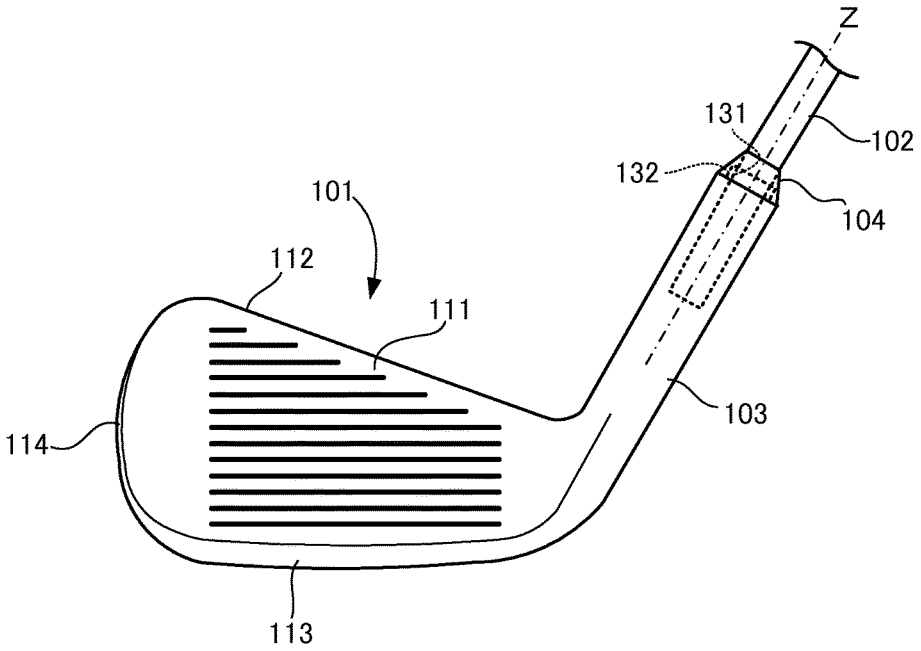
FIG. 1 is a front view of a golf club in a first embodiment of the present invention.
Figure 2:
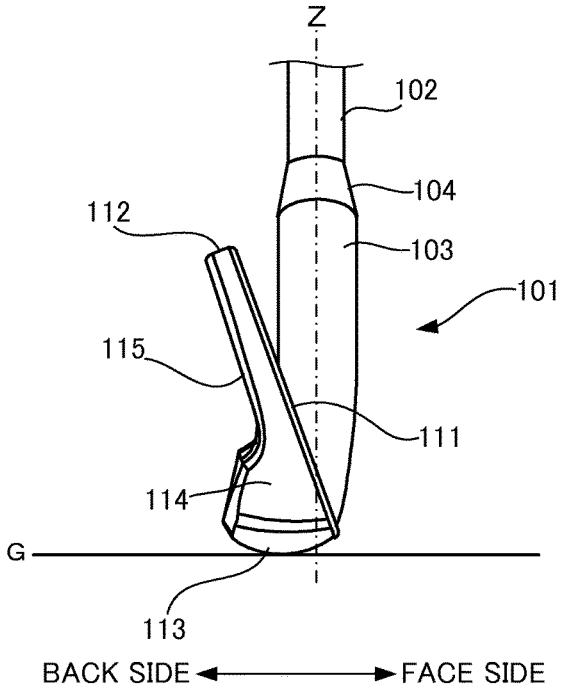
FIG. 2 is aside view in FIG. 1.

A golf club according to a first embodiment of the present invention will hereinafter be described with reference to the drawings. FIG. 1 is a front view of an iron golf club according to the first embodiment. FIG. 2 is a side view of the iron golf club in FIG. 1. Note that the following discussion designates a vertical direction in FIGS. 1 and 2 as "upward or downward", and a description will be made based on this definition of the direction, the definition being applied to other drawings.

1. Outline of Golf Club

As illustrated in FIGS. 1 and 2, the golf club according to the first embodiment is an iron golf club including a golf club head (which will hereinafter be called simply "the head" or the "club head" as the case may be) 101 and a shaft 102 joined to the head 101. The head 101 includes a face surface 111 to hit a ball, a top surface 112 continuous to an upper edge of the face surface 111 and configuring a head upper surface, and a sole surface 113 continuous to a lower edge of the face surface 111 and configuring a head bottom surface. The head 101 further includes a toe surface 114 extending in a smoothly curved shape between the top surface 112 and the sole surface 113, and a back surface 115 configuring a surface opposite to the face surface 111.

A cylindrical hosel 103 including a shaft insertion hole (aperture) 131 receiving insertion of the shaft 102, is provided at an end portion opposite to the toe surface 114 in connection with the top surface 112. The insertion hole 131 has a central axial line Z being coaxial with an axial line of the shaft 102. A male thread 132 is formed along an outer peripheral edge of the aperture of the insertion hole 131. The male thread 132 is provided with a varying mechanism for varying a length of the hosel 103 (the length being hereinafter termed also "a hosel length" or "a neck length"). The varying mechanism will be described later on.

The head 101 according to the first embodiment is configured to include the face surface, i.e., a face plate composed of a metallic material, and a head body composed of a different metallic material from the face plate and having its front surface provided with this face plate. However, the head 101 may be sufficient to be manufactured by forging one type of metallic material or to be a forged product. The shaft 102 is of a broadly known type and may be constructed by use of, e.g., a metal, a resin material and other equivalent materials.

2. Varying Mechanism for Hosel Length

Figure 3:
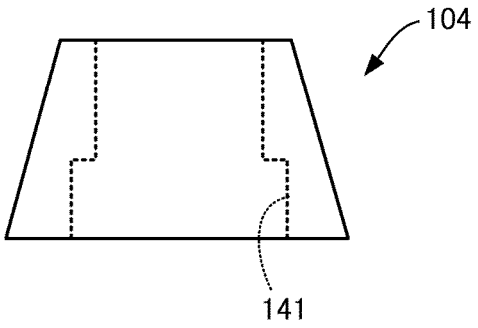
FIG. 3 is a side view of a securing member provided in the golf club in FIG. 1.
Figure 4:
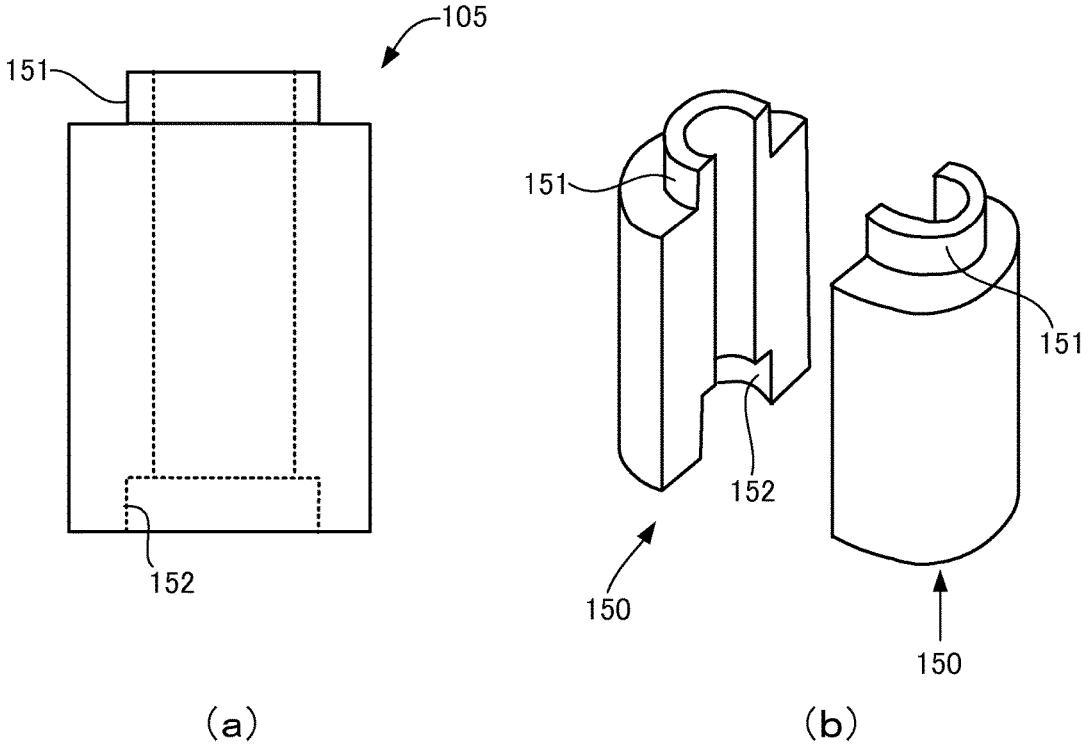
FIG. 4 is a side view and an exploded view illustrating an insert member used for the golf club in FIG. 1.

A varying mechanism for the hosel length will hereinafter be described with reference to FIGS. 3 and 4. FIG. 3 is a front view of a securing member building up the varying mechanism. FIG. 4 illustrates a front view and an exploded view of an insert member building up the varying mechanism. As depicted in FIGS. 3 and 4, the varying mechanism includes a securing member 104 formed in a cylindrical shape and an insert member 105 formed similarly in the cylindrical shape. The securing member 104 and the insert member 105 are fitted to the hosel 103, thereby enabling the hosel length to vary. Each of the securing member 104 and the insert member 105 has substantially the same outside diameter as an outside diameter of the hosel 103. Both of the securing member 104 and the insert member 105 have cylindrical internal spaces receiving insertion of the shaft 102.

The securing member 104 is fitted to an upper end of the hosel 103. The securing member 104 is disposed at a joining portion between the shaft 102 and the hosel 103 to perform a role mainly as an ornament. As illustrated in FIG. 3, the securing member 104, though formed in the cylindrical shape, previously receives insertion of the shaft 102. Thereafter, the shaft 102 is secured to an insertion hole 131 by a bonding material. The securing member 104 is therefore movable along the shaft 102 in an axial direction. The securing member 104 includes a female thread (first securing member) 141 formed along an inner peripheral edge of a lower end in the axial direction. The female thread 141 is screwed to a male thread 132 of the hosel 103. An outer peripheral surface of the securing member 104 is tapered to reduce a diameter gradually toward the upper end from the lower end. The securing member 104 according to the first embodiment may be therefore configured to serve as an annular ornament member generally called a socket, a ferrule or a feral that are attached to the shaft. Note that the securing member 104 according to the first embodiment is tapered and may also take a cylindrical shape not having the tapered portion. The securing member 104 is configured in the cylindrical shape not having the tapered portion, and the annular ornament member may be attached to an upper portion of this securing member 104.

As illustrated in FIG. 4(*a*), the insert member 105 is disposed between the insertion hole 131 of the hosel 103 and the securing member 104 in the axial direction. The insert member 105 is configured in the cylindrical shape longer in the axial direction than the securing member 104. The outer peripheral surface of the upper end of the insert member 105 is formed with a male thread (a third securing portion) 151 screwed to the female thread 141 of the securing member 104. Meanwhile, the lower end of the insert member 105 is formed with a female thread (a second securing portion) 152 screwed to the male thread 132 of the hosel 103. As illustrated in FIG. 4(*b*), the insert member 105 is splitable in a peripheral direction into two insert segments. More specifically, the cylindrical insert member 105 having the cylindrical shape is configured by combining two insert segments 150 each taking a circular arc in section. Note that the insert segments 150 may also be configured to be secured together. For example, one insert segment 150 is provided with a protruded portion, while the other insert segment 150 is provided with a recessed portion, and the protruded portion may engage with the recessed portion. Alternatively, one insert segment 150 is provided with a key way, while the other insert segment 150 is provided with a key, and the key may engage with the key way. Other configurations are, if capable of securing the two insert segments 150 together, not limited in particular.

Exemplary materials, of which the securing member 104 and the insert member 105 can be composed, are hard materials instanced by metals, resins, especially FRP (Fiber Reinforced Plastics) and other equivalent materials.

Figure 5:
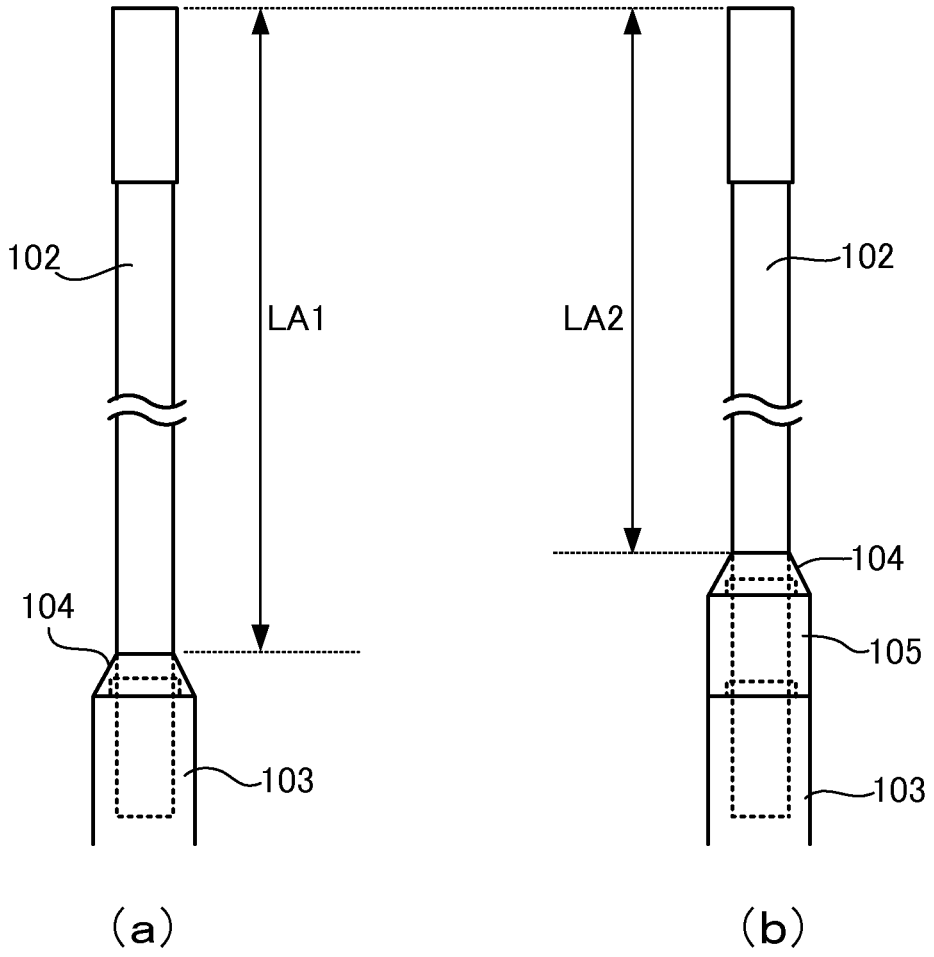
FIG. 5 is a partial side view of the golf club, illustrating a method of using the securing member and the insert member in FIGS. 3 and 4.

A method for using the varying mechanism will next be described with reference to FIG. 5. The varying mechanism according to the first embodiment enables two hosel lengths to be selected. To be specific, there are a first mode for using only the securing member 104 and a second mode for using the securing member 104 and the insert member 105. The discussion will start with the first mode. In the first mode, as illustrated in FIG. 5(*a*), the female thread 141 of the securing member 104 is screwed to the male thread 132 of the insertion hole 131. Note that the shaft 102 is secured to the hosel 103, and hence only the securing member 104 is moved along the shaft 102 and then secured to the hosel 103. Consequently, a length from the upper end of the securing member 104 to a rear end portion of the shaft 102 becomes a length LA1 at which a flexure is caused when swinging the club.

Subsequently, the discussion will deal with the second mode. A shift to the second mode from the first mode involves at first removing the securing member 104 from the hosel 103. Next, the securing member 104 is moved along the shaft 102 and separated from the hosel 103. Subsequently, as illustrated in FIG. 5(*b*), the insert member 105 is fitted to the shaft 102. A couple of insert segments 150 are combined to take the cylindrical shape along an outer periphery of the shaft 102, thus configuring the insert member 105. Hereat, an axis-direction position for disposing the two insert segments 150 exists between the hosel 103 and the securing member 104. A female thread 152 of the lower end of the insert member 105 is next screwed to the male thread 132 of the hosel 103. Finally, the female thread 141 of the securing member 104 is screwed to the male thread 151 of the upper end of the insert member 105. The second mode is thus completed. In the second mode, the length from the upper end of the securing member 104 to the rear end portion of the shaft 102 becomes a length LA2 at which the flexure is caused. The length LA2 is shorter by an axis-directional length of the insert member 105 than the length LA1 in the first mode. The length of the shaft 102 to cause the flexure therefore shortens. As a result, hardness of the shaft 102 upon swinging can be varied.

As described above according to the first embodiment, the length of the hosel 103 can be varied simply by attaching and detaching the securing member 104 and the insert member 105 without removing the shaft 102 from the golf club head 101. Accordingly, the hardness of the shaft 102 can be easily varied. Note that a length of the flexure can be varied at a plurality of stages simply by preparing a plurality of insert members having different axis-directional lengths without being limited to one type of insert member.

B. Second Embodiment

The golf club according to a second embodiment of the present invention will hereinafter be described with reference to FIGS. 6 through 9. Differences of the second embodiment from the first embodiment are configurations of the varying mechanism and the insertion hole, but other configurations are the same, and therefore the repetitive explanations thereof are omitted.

The first embodiment has discussed how the hosel length is varied depending on the use of the insert member 105 and the non-use thereof. However, in the second embodiment, the hosel length is varied by using the plurality of insert members having the different axis-directional lengths.

Figure 6:
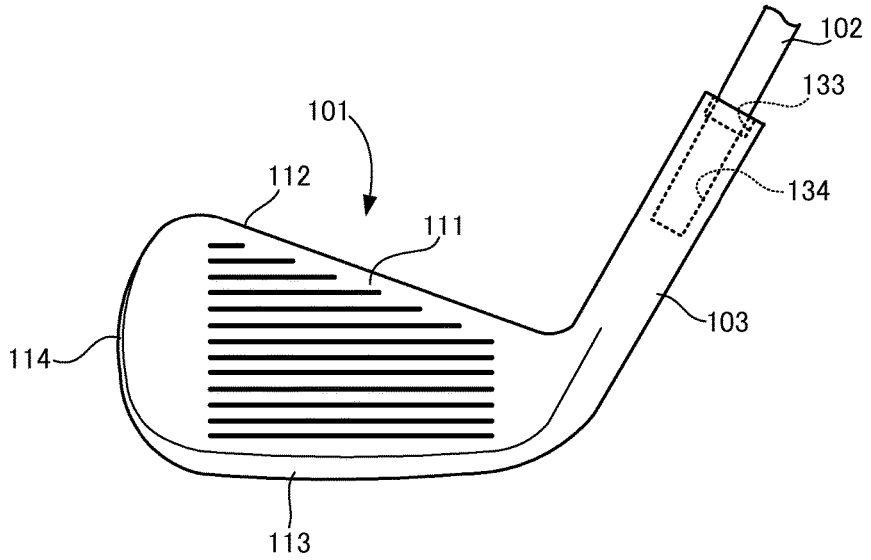
FIG. 6 is a partial front view of the golf club in a second embodiment of the present invention.

As illustrated in FIG. 6, the golf club head according to the second embodiment includes a hole 133 having a large diameter and a hole 134 having a small diameter. The hole 133 is formed in the tip of the hosel 103, and the hole 134 is formed therein concentrically with the hole 133. An inner peripheral surface of the large-diameter hole 133 is formed with a female thread, and an after-mentioned male thread of the insert member is screwed to this female thread. The small-diameter hole 134 configures the insertion hole receiving the insertion of the shaft 102. The securing member 104 is the same as the securing member used in the first embodiment, and hence the repetitive explanation thereof is omitted.

Herein, two types of insert members, i.e., a first insert member 106 and a second insert member 107 are used. The two insert members are, however, different in axis-directional length, and other configurations are the same as those described above. Accordingly, the following discussion will describe the first insert member 106.

Figure 7:
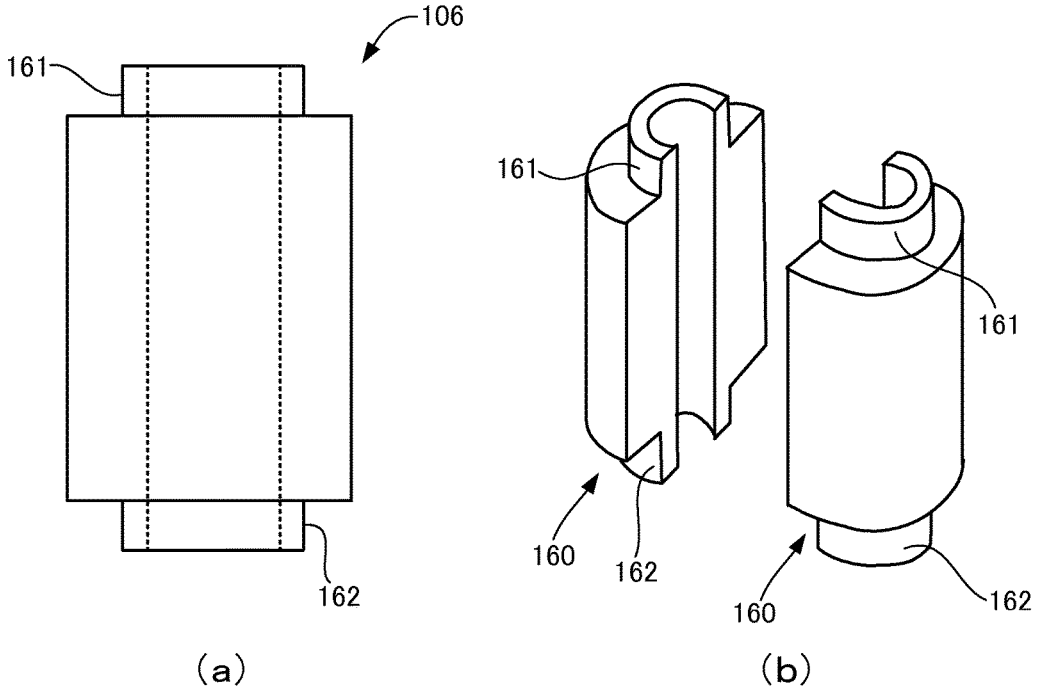
FIG. 7 is a side view and an exploded view illustrating the insert member used for the golf club in FIG. 6.

As illustrated in FIG. 7(*a*), the first insert member 106 is formed in the cylindrical shape and includes a male thread (a third securing portion) 161 screwed to the female thread 141 of the securing member 104, the male thread 161 being formed on an outer peripheral surface of the upper end of the first insert member 106. Meanwhile, the first insert member 106 includes a male screw (a second securing portion) 162 screwed to the female thread of the large-diameter hole 133 of the hosel, the male screw 162 being formed on the lower end of the first insert member 106. Further, as illustrated in FIG. 7(*b*), the first insert member 106 can be split into two segments in the peripheral direction. More specifically, the first insert member 106 having the cylindrical shape is configured by combining the two insert segments 160 each taking a circular arc in section.

Note that the materials for building up the first and second insert members 106, 107 are the same as the materials in the first embodiment.

Figure 8:
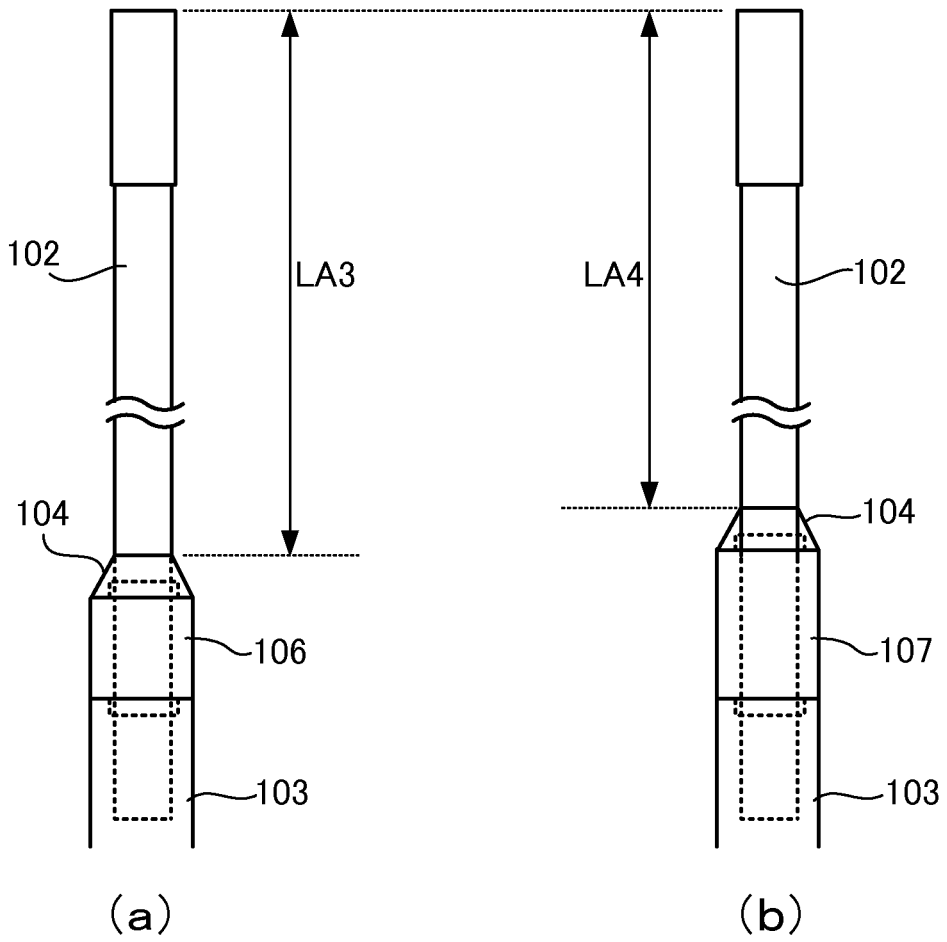
FIG. 8 is a partial side view of the golf club, illustrating a method of using the securing member and the insert member in the second embodiment.

A method for using the varying mechanism will next be described with reference to FIG. 8. The varying mechanism according to the second embodiment enables two neck lengths to be selected. To be specific, there are a first mode for using the securing member 104 and the first insert member 106 and a second mode for using the securing member 104 and the second insert member 107. The discussion will start with the first mode. In the first mode, at first the securing member 104 is separated from the hosel 103. Next, as illustrated in FIG. 8(*a*), the first insert member 106 is fitted to the shaft 102. To be specific, a couple of first insert segments 106 are combined to take the cylindrical shape along the outer periphery of the shaft 102, thus configuring the first insert member 106. Hereat, an axis-direction position for disposing the two insert segments 160 exists between the hosel 103 and the securing member 104. A female thread 162 of the lower end of the insert member 106 is next screwed to the male thread of the large-diameter hole 133 of the hosel 103. Finally, the female thread 141 of the securing member 104 is screwed to the male thread 161 of the upper end of the insert member 106. The first mode is thus completed. In the first mode, the length from the upper end of the securing member 104 to the rear end portion of the shaft 102 becomes a length LA3 at which the flexure is caused.

Subsequently, the discussion will deal with the second mode. The second mode has only a difference of using the second insert member 107 in place of the first insert member 106, and fitting method remains the same. Hence, a detailed description is omitted. In the second mode, as depicted in FIG. 8(*b*), the length from the upper end of the securing member 104 to the rear end portion of the shaft 102 becomes a length LA4 at which the flexure is caused. The length LA4 is shorter by a difference in axis-directional length between the first insert member 106 and the second insert member 107 than the length LA3 in the first mode.

As described above, the second embodiment can acquire the same effects as the effects of the first embodiment. Note that three or more types of insert members may be prepared without being limited to the two types.

Modified Example

The first and second embodiments of the present invention have been discussed so far. The present invention is not, however, limited to the embodiments described above but may be modified in a variety of forms as far as not deviating from the gist of the invention. For example, the following modifications are enabled.

Modified Example 1

Figure 9:
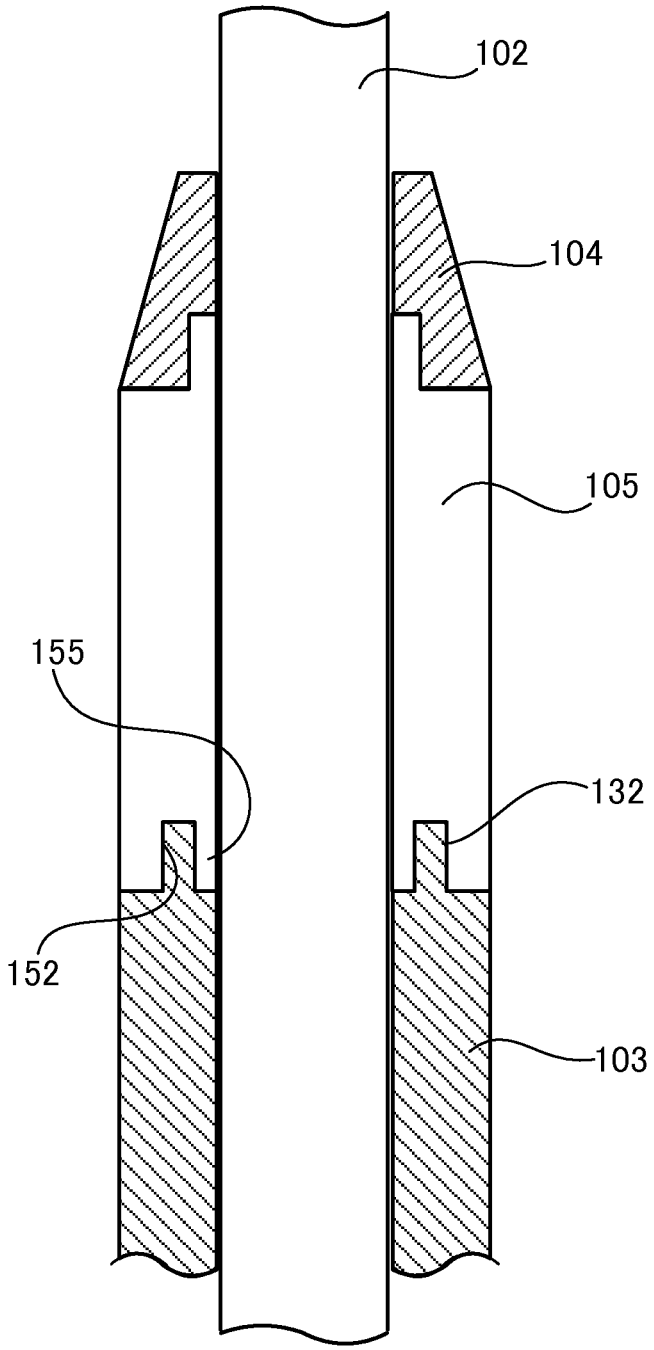
FIG. 9 is a sectional view illustrating another example of a method of securing the insert member and the hosel together.

For instance, a modified example 1 can be attained as illustrated in FIG. 9. This modified example 1 is that an annular protrusion 155 is formed inward in the radial direction with respect to the female thread 152 formed in the lower end of the insert member 105 of the first embodiment. To be specific, an annular groove is formed between the female thread 152 and the protrusion 155. The upper end of the hosel 103 is fitted in this annular groove. This configuration enables prevention of the lower end portions of the insert segments 150 from being separated from each other in the radial direction, and further enables the insert member 105 to be firmly secured to the hosel 103.

Modified Example 2

Each of the insert members 105, 106, 107 is configured to be split into the two insert segments in the embodiments described above. The insert member may be, however, split into three or more insert segments. In any case, the insert members 105, 106, 107 are splitable and can therefore cover the outer peripheral surface of the shaft 102 from the radial direction without inserting these insert members through the shaft 102.

Modified Example 3

Figure 10:
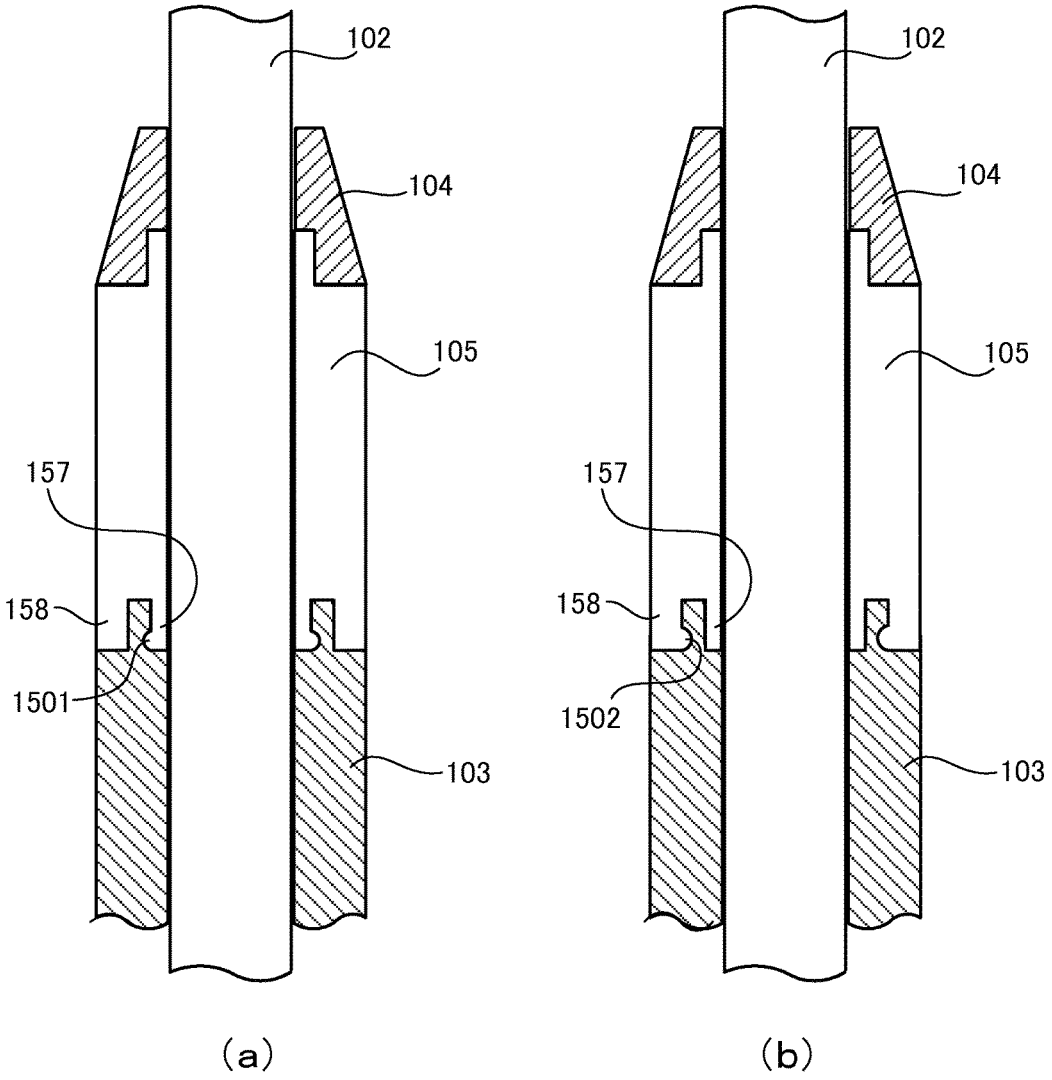
FIG. 10 is a sectional view illustrating still another example of the method of securing the insert member and the hosel together.

The securing member 104, the insert members 105, 106, 107 and the peripheral edge of the aperture of the insert hole 131 are secured by the threads in the embodiments described above. Any inconvenience may not be caused by reversing a relation between the male thread and the female thread. Securing methods using means other than the threads are also available but are not particularly limited if capable of securing attachably and detachably. For example, as illustrated in FIG. 10, a snap fitting mechanism may also be available. This mechanism is that annular protrusions 157, 158 to pinch the peripheral edge of the aperture of the hosel 103 inward and outward in the radial direction are formed on the end of the insert member 105, come-off preventive protrusion pieces 1501, 1502 engaging with the peripheral edge of the aperture of the hosel 103 are provided at least one of the protrusion 157 protruding inward in the radial direction and the protrusion 158 protruding outward in the radial direction. With these protrusion pieces 1501, 1502 being composed of an elastically deformable material, the insert member 105 can be secured not depending on the securing by the threads. This mechanism may be used for securing the securing member and the insert members 105, 106, 107 together.

Modified Example 4

The embodiments have discussed the examples of the iron golf club. The varying mechanism described above is, however, applicable to a wood golf club.

One aspect of each of the embodiments described above aims at providing the golf club capable of adjusting the hosel length easily. As describe above, each of the embodiments described above can provide the golf club capable of adjusting the hosel length easily.

C. Third Embodiment

The golf club according to a third embodiment of the present invention will hereinafter be described with reference to FIGS. 11-19.

1. Whole Structure of Golf Club

Figure 11:
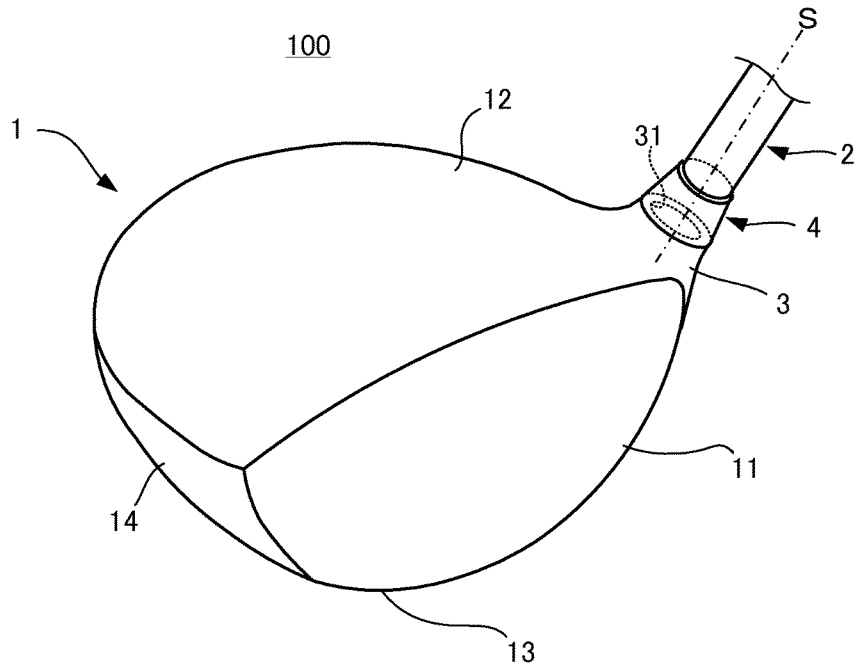
FIG. 11 is a perspective view illustrating an overall structure of the golf club according to a third embodiment.
Figure 12:
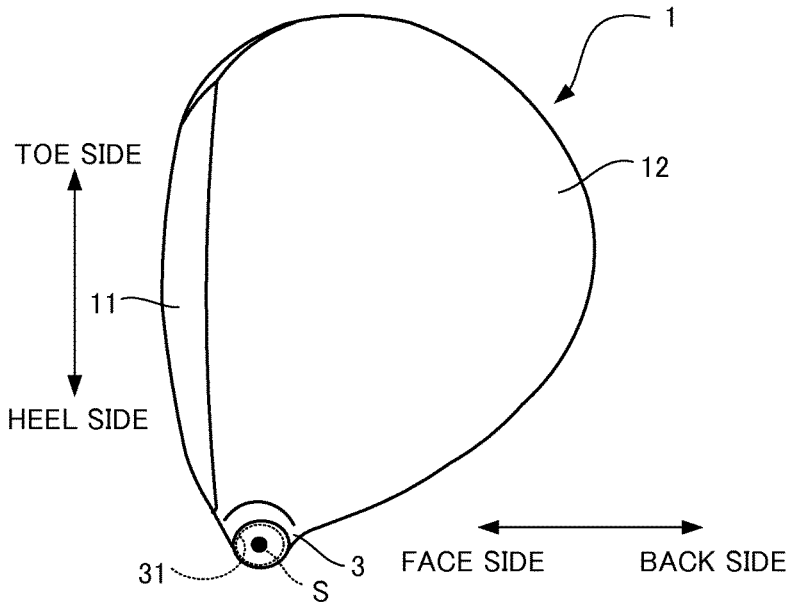
FIG. 12 is a plan view illustrating the golf club head according to the third embodiment.
Figure 13:
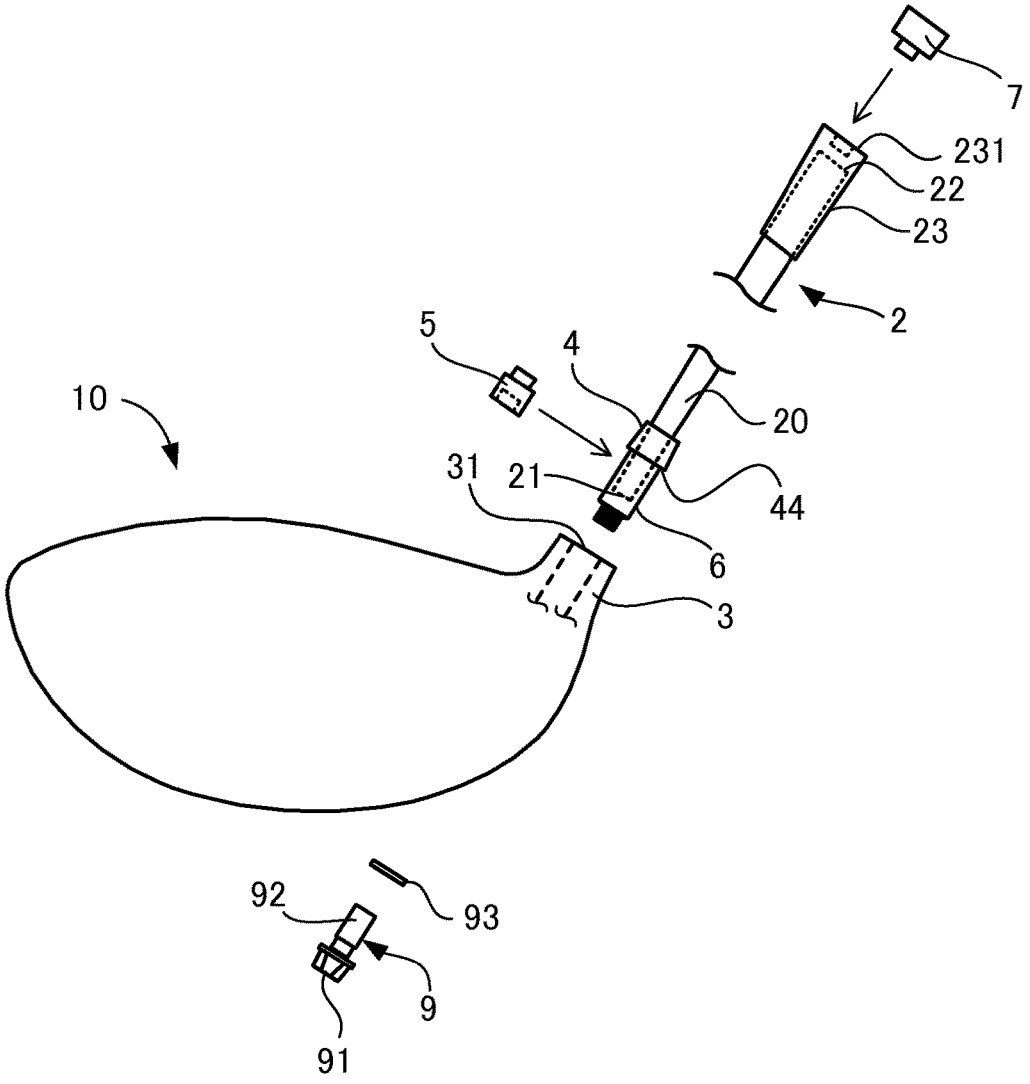
FIG. 13 is an exploded view illustrating a structure of joining the golf club head and the shaft together according to the third embodiment.

The discussion will start with a whole structure of the golf club with reference to FIGS. 11-13. FIG. 11 is a perspective view illustrating the whole structure of a golf club 10 according to a third embodiment. FIG. 12 is a plan view illustrating a golf club head 1 according to the third embodiment. FIG. 13 is an exploded view illustrating a structure of joining the shaft 2 and the golf club 1 together.

As depicted in FIGS. 11 and 12, the golf club 10 according to the third embodiment includes a shaft 2 and the golf club head 1 (which will hereinafter be simply termed the "head") joined to an end portion (a lower end 21) of the shaft 2. As illustrated in FIG. 13, the shaft 2 and the golf club head 1 are joined together via a first adjusting mechanism (an engaging member 4, an insert member 5, a shaft securing member 6) that will be described later on. An after-mentioned second adjusting mechanism (an extension member 7) is configured to be connectable to a grip end 231 of the shaft 2. This configuration according to the third embodiment enables a variation of deflectability of the shaft by varying neither the club length nor the neck length. Note that the club length from the edge of the shaft on the side of the grip end 231 to the bottom surface of the head 1 may not be strictly defined if an approximate length can be given. The club length may be measured by, e.g., a 60-degrees method based on a 60-degree lie angle as a standard angle, a heel end method and other equivalent methods specified in the Rules of Golf. The neck length from the upper end portion (the upper end 36) of the hosel 103 to the upper end portion (the upper end 43) of the engaging member 4 may not be strictly defined if an approximate length can be given.

The shaft 2 includes a shaft body 20 formed in a hollowed cylindrical shape and a cylindrical grip 23 that opens toward the lower end. The shaft body 20 includes a lower end 21 and an upper end 22 at both ends in the axial direction. The shaft body 20 is configured to increase an outside diameter toward the upper end 22 from the lower end 21. The golf club head 1 is joined to the lower end 21 of the shaft body 20. As illustrated in FIG. 13, the grip 23 composed of a rubber and other equivalent materials is secured to the upper end 22 of the shaft body 20. The after-mentioned extension member 7 can be fitted to the grip end 231 of the grip 23.

A material of the shaft body 20 may be properly selected corresponding to the embodiment and may involve using, e.g., CFRP (Carbon Fiber Reinforced Plastic), steel and other equivalent materials. The lower end 21 of the shaft body 20 corresponds to a "front end portion of the shaft" according to the present invention. The grip end 231 corresponds to a "read end portion of the shaft" according to the present invention. An extending direction of the shaft 2 (the shaft body 20) corresponds to an "axial direction" according to the present invention. The "axial direction" may not, however, be strictly defined if enabling the upper end portions and the lower end portions of the respective members to be connected to each other.

The golf club head 1 has a hollowed structure. As illustrated in FIGS. 11 and 12, an external surface of the golf club head 1 is configured by a face 11, a crown 12, a sole 13, a side 14 and a hosel 3. The face 11 has a face surface to hit the golf ball. The crown 12 is adjacent to the face 11 to configure an upper surface of the head 1. The sole 13 configures the bottom surface of the head 1 and is adjacent to the face 11 and the side 14. The side 14 is a portion between the crown 12 and the sole 13. The side 14 is also a portion passing through a back side of the head 1 from a toe side of the face 11 and extending to the heel side of the face 11.

The hosel 3 is a cylindrical portion provided adjacent to the heel side of the crown 12, and includes a fitting hole (aperture) 31 for fitting the shaft 2. Specifically, the fitting hole 31 receives insertion of an after-mentioned shaft securing member 6 together with the shaft 2, the securing member 6 being secured to the front end portion of the shaft 2. An in-depth description of an internal structure of the hosel 3 will be made later on. Note that the head 1 described in the third embodiment is of a wood type instanced by a driver (#1) or a fairway wood, but is not limited to the type thereof. The head 1 may adopt a variety of types instanced by a so-called utility type, a so-called hybrid type, a so-called iron type, a so-called putter type and other equivalent types.

2. Joint Structure (First Adjusting Mechanism) Between Shaft and Golf Club Head

Next, a joint structure between the shaft 2 and the golf club head 1 will be described with reference to FIG. 13 and FIGS. 14-17B. As illustrated in FIG. 13, the lower end 21 of the shaft body 20 is secured by the shaft securing member 6. The engaging member 4 is disposed on an upper end side of the shaft securing member 6. The insert member 5 can be disposed between the engaging member 4 and the shaft securing member 6. The configuration enables extension of a length for securing (restricting) the lower end 21 of the shaft body 20.

The insert member 5 and the shaft securing member 6 are configured to be insertable into the fitting hole 31 of the hosel 3. However, the engaging member 4 is configured to engage with the upper end (the peripheral edge of the aperture of the fitting hole 31) of the hosel 3. Irrespective of whether a fitting state or a non-fitting state of the insert member 5, the lower end 21 of the shaft body 20 can be therefore inserted into the internal space of the hosel 3 by inserting the shaft securing member 6 into the fitting hole 31 till the engaging member 4 engages with the upper end of the hosel 3. Hereat, shaft securing member 6 (and the insert member 5) can be secured in a state of being housed in the internal space of the hosel 3 by use of a washer 93 and a fixture 9. The shaft 2 (the shaft body 20) and the golf club head 1 are thereby joined. Components of this joint structure will hereinafter be described.

[Hosel]

Figure 14:
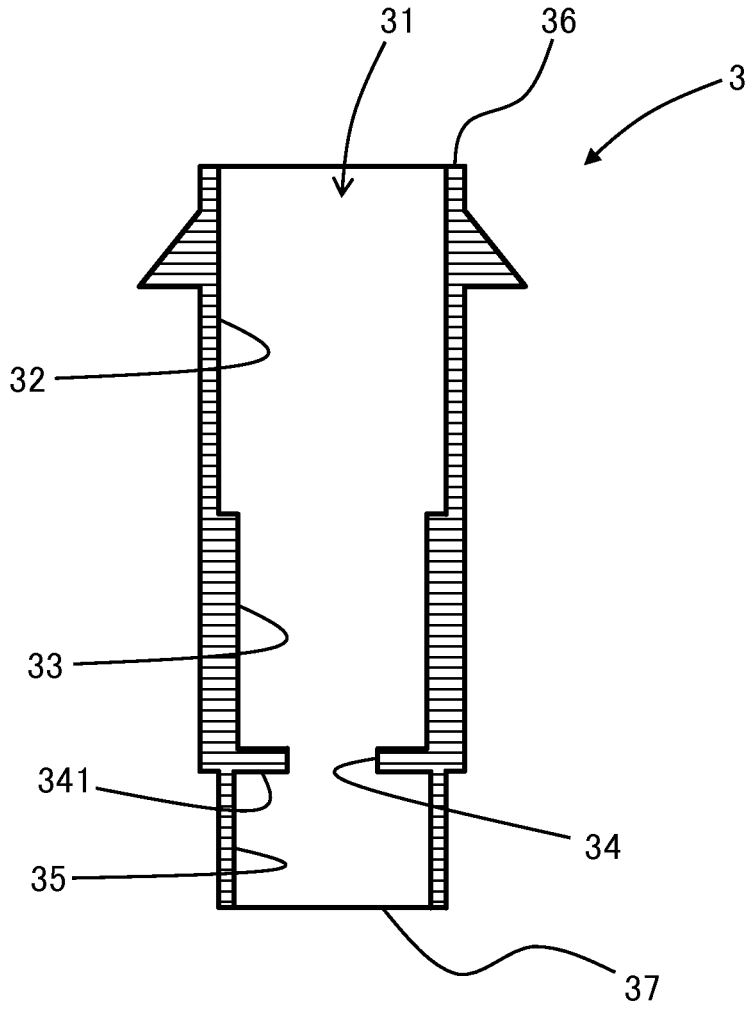
FIG. 14 is a sectional view schematically illustrating an internal space of the hosel according to the third embodiment.

To begin with, the internal space of the hosel 3, into which the insert member 5 and the shaft securing member 6 are inserted, will be described by using FIG. 14. FIG. 14 is a sectional view schematically illustrating the internal space of the hosel 3. As depicted in FIG. 14, the internal space of the hosel 3 according to the third embodiment is configured to include a first diametral portion 32, a second diametral portion 33 and a third diametral portion 35 in the sequence from an upper end 36.

The first diametral portion 32 is formed in a cylindrical shape, and opens at the upper end 36. The second diametral portion 33 is continuous to the first diametral portion 32 and formed in the cylindrical shape being slightly smaller in diameter than the first diametral portion 32. The second diametral portion 33 has an inner peripheral surface formed with a plurality of groove lines (unillustrated) corresponding to a plurality of protrusion lines 621 formed along an outer peripheral surface of a second cylindrical portion 672 of the shaft securing member 6. In the third embodiment, the first diametral portion 32 and the second diametral portion 33 cooperate to form the fitting hole 31 that opens at the upper end 36.

The third diametral portion 35 taking the cylindrical shape is disposed on the side of the lower end of the second diametral portion 33. A partition wall 341 is provided between the third diametral portion 35 and the second diametral portion 33. The partition wall 341 is formed with a circular aperture 34 being smaller in diameter than the second diametral portion 33 and third diametral portion 35. The aperture 34 penetrates the interior in a vertical direction. The partition wall 341 is therefore formed in an annular shape. The second diametral portion 33 communicates with the third diametral portion 35 via the aperture 34. Note that the third diametral portion 35 opens at the lower end 37. With this configuration, the internal space of the hosel 3 penetrates toward the side 14 and the sole 13 of the head 1 substantially in parallel with the axial direction of the shaft 2.

When assembling the golf club 10, the shaft securing member 6 (and the insert member 5) is inserted from the upper end 36 into the first diametral portion 32 and the second diametral portion 33 of the hosel 3. The engaging member 4 is disposed on the upper end side of the shaft securing member 6 (and the insert member 5) and is formed larger in outside diameter than the first first diametral portion 32. Consequently, the shaft securing member 6 (and the insert member 5) can be inserted downward in the axial direction till the lower end 44 of the engaging member 4 engages with the upper end portion (the upper end 36) of the hosel 3. On the other hand, the washer 93 and the fixture 9 having a thread are inserted into the third diametral portion 35 from the lower end 37. The fixture 9 is screwed-fastened to the shaft securing member 6. The shaft 2 and the golf club head 1 are thereby removably secured.

Note that the fixture 9 is constructed to include a head portion 91 and a thread portion 92 joined to the head portion 91 as depicted in FIG. 13. The thread portion 92 is formed smaller in diameter than the aperture 34 so that the thread portion 92 can be inserted into the aperture 34 to reach the second diametral portion 33 from the lower end 37. By contrast, the head portion 91 is formed larger in diameter that the aperture 34 so that the overall fixture 9 does not pass through the aperture 34. The head portion 91 is formed with a rectangular recessed portion (unillustrated) receiving insertion of a wrench. A user is consequently enabled to fasten or unfasten the golf club head 1 and the shaft 2 operating the wrench being fitted in the recessed portion.

[Shaft Securing Member]

Figure 15:
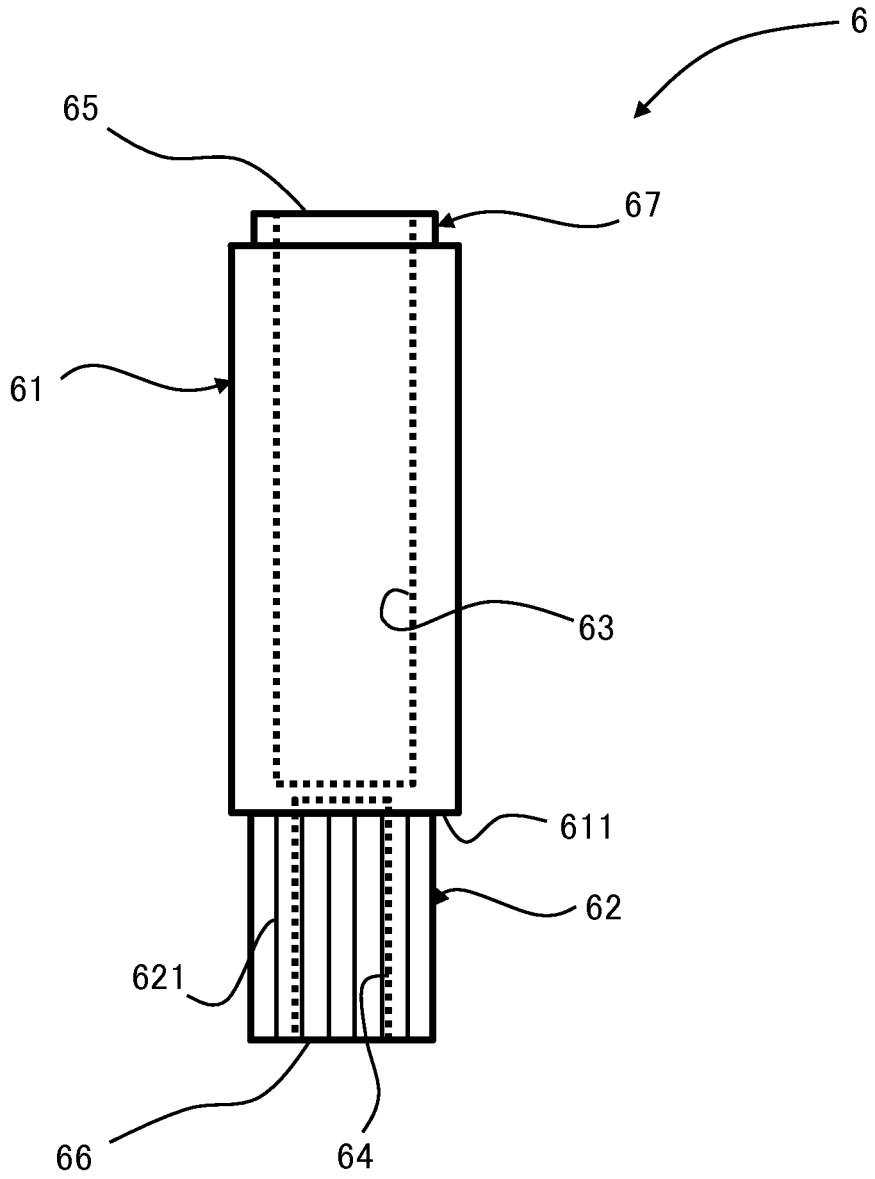
FIG. 15 is a front view schematically illustrating a shaft securing member according to the third embodiment.

The shaft securing member 6 according to the third embodiment will next be described with reference to FIG. 15. FIG. 15 is a front view schematically illustrating the shaft securing member 6 according to the third embodiment. As illustrated in FIG. 15, the shaft securing member 6 according to the third embodiment includes the upper end 65 and the lower end 66 at both ends in the axial direction (in the vertical direction in the drawings). The shaft securing member 6 includes a protruded portion 67, a first cylindrical portion 61 and a second cylindrical portion 62 sequentially from the upper end 65.

The first cylindrical portion 61 is a portion to be inserted into the first diametral portion 32 of the hosel 3. An outside diameter of the first cylindrical portion 61 is larger than an inside diameter of the second diametral portion 33 of the hosel 3 and is set to such a degree as to be insertable into the first diametral portion 32 of the hosel 3. Therefore, with the after-mentioned engaging member 4 not being taken into consideration, the shaft securing member 6 can be inserted into the internal space of the hosel 3 till an end surface 611 of the first cylindrical portion 61 on the side of the lower end 66 engages with a stepped portion formed between the first diametral portion 32 and the second diametral portion 33.

The second cylindrical portion 62 to be disposed on the lower end side of the first cylindrical portion 61 is a portion to be inserted into the second diametral portion 33 of the hosel 3. Consequently, an outside diameter of the second cylindrical portion 62 is smaller than an outside diameter of the first cylindrical portion 61, and is set to such a degree as to be insertable into the second diametral portion 33 of the hosel 3. An outer peripheral surface of the second cylindrical portion 62 is formed with a plurality of protrusion lines 621 extending in the axial direction. The protrusion lines 621 correspond to groove lines to be formed in an inner peripheral surface of the second diametral portion 33 of the hosel 3.

Hence, the shaft securing member 6 is inserted in the axial direction into the fitting hole 31 of the hosel 3, at which time the plurality of protrusion lines 621 formed along the second cylindrical portion 62 of the shaft securing member 6 engages with the plurality of groove lines formed along the second diametral portion 33 of the hosel 3. The shaft securing member 6 and the hosel 3 are thereby joined together so as to be rotation-disabled in a periaxial direction (peripheral direction). Note that the phrase "being joined" or a term "joining" connotes herein at least "the two members being secured not to be movable" but is not requested "to prevent the two members from being separated even by receiving an external force applied". The same definition is applied to the phrase "being joined" or the term "joining" to be used as below.

The cylindrical protruded portion 67 protruding upward is formed on the upper end side of the first cylindrical portion 61. The protruded portion 67 is formed smaller in outside diameter than the first cylindrical portion 61. An outer peripheral surface of the protruded portion 67 is formed with a male thread to engage with a recessed portion 42 of the engaging member 4 and with a recessed portion 54 of the insert member 5, these recessed portions being mentioned later on.

The shaft securing member 6 has an external shape extending in the vertical direction. The shaft securing member 6 includes a use-for-shaft recessed portion 63 opening on the side of the upper end 75 in an area substantially covering the vicinity of the lower end of the first cylindrical portion 61 from the upper end of the protruded portion 67. The use-for-shaft recessed portion 63 has a cylindrical inner peripheral surface extending in the vertical direction. The use-for-shaft recessed portion 63 receives insertion of the lower end 21 of the shaft body 20. The shaft body 20 is secured to the use-for-shaft recessed portion 63 by a securing means instanced by a bonding agent and other equivalent agents. An axial center S (see FIGS. 11 and 12) of the shaft 2 is thereby fixed so as to extend in an extending direction (the vertical direction in FIG. 15) of the use-for-shaft recessed portion 63. Note that a bonding agent for securing the shaft body 20 may be, without being limited to a particular agent, properly selected corresponding to the embodiment.

The shaft securing member 6 further has a use-for-fixture recessed portion 64 opening on the side of the lower end 66 in an area substantially covering existence of the second cylindrical portion 62. An inside diameter of the use-for-fixture recessed portion 64 corresponds to an outside diameter of the thread portion 92 of the fixture 9. The use-for-fixture recessed portion 64 has its inner peripheral surface formed with a female thread (unillustrated) to which a male thread (unillustrated) formed on an outer peripheral surface of the thread portion 92 is screwed. Consequently, after inserting the shaft securing member 6 into the fitting hole 31 of the hosel 3, the fixture 9 is inserted into the internal space from the lower end 37 of the hosel 3, and the thread portion 92 of the fixture 9 is screwed to the use-for-fixture recessed portion 64 of the shaft securing member 6, thereby enabling the fixture 9 and the shaft securing member 6 to be screw-fastened together.

[Engaging Member]

Figure 16:
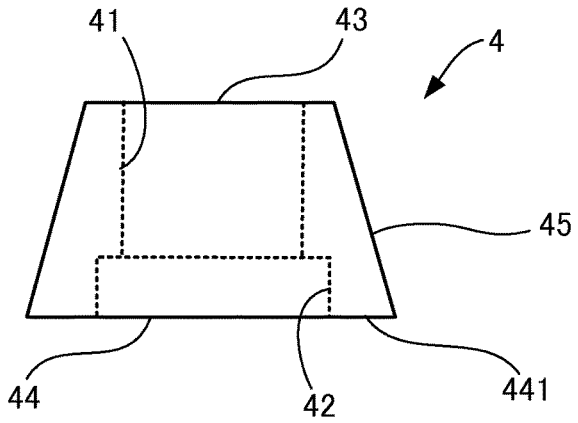
FIG. 16 is a front view schematically illustrating the engaging member according to the third embodiment.

The engaging member 4 according to the third embodiment will next be described with reference to FIG. 16. FIG. 16 is a front view schematically illustrating the engaging member 4 according to the third embodiment. As illustrated in FIG. 16, the engaging member 4 according to the third embodiment is formed in the cylindrical shape to enable coverage of the outer peripheral surface of the shaft body 20 and is fitted to the protruded portion 67 of the shaft securing member 6 or an after-mentioned protruded portion 51 of the insert member 5.

The engaging member 4 opens at both of the upper end 43 and the lower end 44. The engaging member 4 includes a cylindrical through-hole 41 penetrating in the vertical direction. An inside diameter of the area of the through-hole 41 on the side of the upper end 43 is set to such a degree as to enable the insertion of the shaft body 20. On the other hand, a cylindrical recessed portion 42 having an inside diameter larger than this area on the side of the upper end 43, is formed on the side of the lower end 44 of the through-hole 41.

The protruded portion 67 of the shaft body 20 and the after-mentioned protruded portion 51 of the insert member 5 are fitted in the recessed portion 42. The inside diameter of the recessed portion 42 is therefore set to such a degree as to make the two protruded portions (51, 67) insertable therein. An inner peripheral surface of the recessed portion 42 is formed with a female thread engaged with a male thread formed in each of the protruded portions (51, 67).

On the other hand, the engaging member 4 has the outer peripheral surface 45 being tapered so that the outside diameter thereof gradually expands toward the lower end 44. The outer peripheral surface 45 of the engaging member 4 at the lower end is formed to have a larger outside diameter than the inside diameter of the first diametral portion 32. With this configuration, the engaging member 4 is not fitted in the first diametral portion 32 of the hosel 3, while the end surface 441 of the engaging member 4 on the side of the lower end 44 engages with the upper end 36 (the peripheral edge of the aperture) of the hosel 3.

The engaging member 4 is previously inserted into the shaft body 20. To be specific, the engaging member 4 is inserted into the shaft body 20 before the shaft securing member 6 is attached to the lower end 21 of the shaft body 20. Thereafter, the shaft securing member 6 is attached and then secured to the lower end 21 of the shaft body 20. Hence, with the after-mentioned insert member 5 not being taken into consideration, the engaging member 4 is movable in the axial direction along the shaft body 20 as far as not causing the female thread of the recessed portion 42 to be screwed to the male thread of the protruded portion 67 of the shaft body securing member 6.

[Insert Member]

Figure 17A:
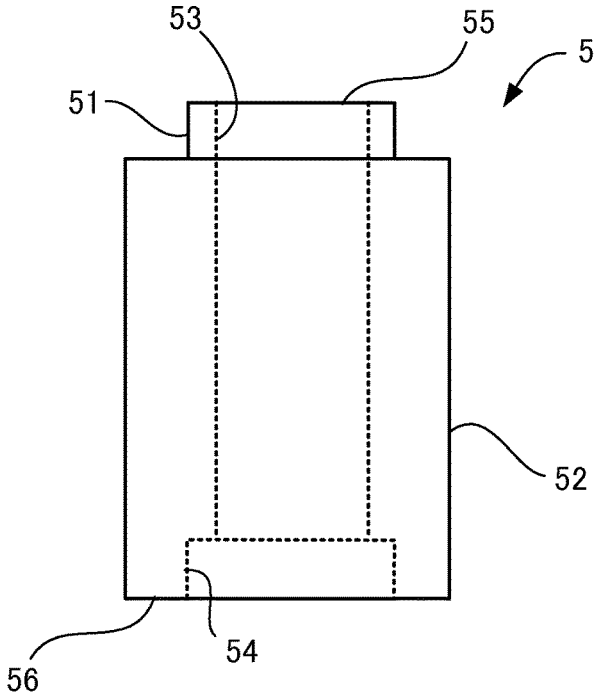
FIG. 17A is a front view schematically illustrating the insert member (in a cylindrical state) according to the third embodiment.
Figure 17B:
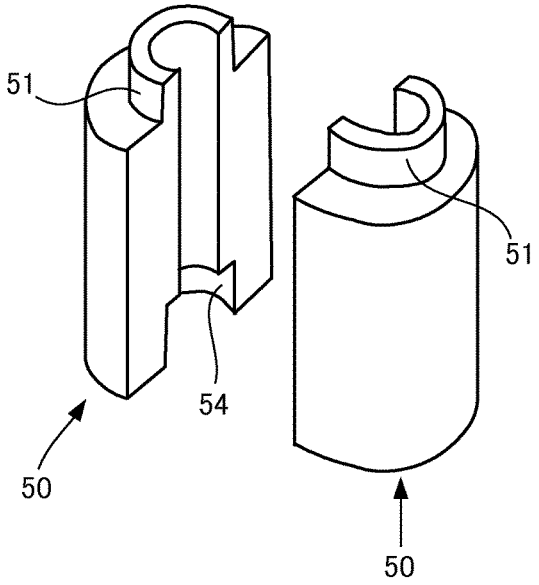
FIG. 17B is a perspective view schematically illustrating the insert member (split state) according to the third embodiment.

The insert member 5 will next be described with reference to FIGS. 17A and 17B. FIG. 17A is a front view schematically illustrating the insert member 5 kept in a cylindrical state. FIG. 17B is a perspective view schematically illustrating the insert member 5 in a split state.

The insert member 5 is a member disposed between the engaging member 4 and the shaft securing member 6 when fitted to the shaft body 20. The insert member 5 may be configured to have a larger axis-directional length than the engaging member 4. The axis-directional length of the insert member 5 may be, however, properly selected corresponding to the embodiment without being limited to the example given above. As depicted in FIG. 17A, the insert member 5 is formed in the cylindrical shape enabling the coverage of the outer peripheral surface of the shaft body 20. The insert member 5 includes the protruded portion 51 and the body portion 52 sequentially from the upper end 55.

The protruded portion 51 is a portion fitted in the recessed portion 42 and is configured the same as the protruded portion 67 of the shaft securing member 6 is. To be specific, the protruded portion 51 is formed in the cylindrical shape and has the outer peripheral surface formed with a male thread screwed to a female thread of the recessed portion 42.

On the other hand, the body portion 52 is a portion to be inserted into the first diametral portion 32 of the hosel 3 when the insert member 5 is fitted to the shaft body 20, and is configured the same as the first cylindrical portion 61 of the shaft securing member 6 is. Specifically, the body portion 52 is formed in the cylindrical shape and has substantially the same outside diameter as the outside diameter of the first cylindrical portion 61, the outside diameter being set to such as decree as to be insertable into the first diametral portion 32 of the hosel 3.

The body portion 52 corresponds to a portion to extend a length for securing the lower end 21 of the shaft body 20 when disposing the insert member 5 between the engaging member 4 and the shaft securing member 6. The axis-directional length of the body portion 52 corresponds to an increment of the axis-directional length to restrict the lower end 21 of the shaft body 20 when fitting the insert member 5.

The insert member 5 opens on both sides of the upper end 55 and the lower end 56, and includes a cylindrical through-hole 53 that penetrates in the vertical direction. Similarly to the through-hole 41 of the engaging member 4, an inside diameter of the area of the through-hole 53 on the side of the upper end 55 is set to such a degree as to make the shaft body 20 insertable. On the other hand, the cylindrical recessed portion 54 having a larger inside diameter than the area on the side of the upper end 55, is formed on the side of the lower end 56 of the through-hole 53.

The recessed portion 54 is configured substantially the same as the recessed portion 42 of the engaging member 4 is. The protruded portion 67 of the shaft securing member 6 is fitted in the recessed portion 54 when the insert member 5 is disposed between the engaging member 4 and the shaft securing member 6. An inside diameter of the recessed portion 54 is therefore set to such a degree as to make the protruded portion 67 insertable. The inner peripheral surface of the recessed portion 54 is formed with the female thread that can be screwed to the male thread formed on the protruded portion 67.

Accordingly, the protruded portion 67 (male thread) of the shaft securing member 6 can be screwed to the recessed portion 54 (female thread) of the insert member 5, and the protruded portion 51 (male thread) of the insert member 5 can be screwed to the recessed portion 42 (female thread) of the engaging member 4. With this contrivance, the insert member 5 can be disposed between the engaging member 4 and the shaft securing member 6, and the insert member 5 can be fitted to the shaft body 20.

Herein, the lower end 21 of the shaft body 20 is inserted and secured to the use-for-shaft recessed portion 63 of the shaft securing member 6. In other words, the use-for-shaft recessed portion 63 of the shaft securing member 6 restricts one upper area from the lower end 21. The engaging member 4, with the through-hole 41 covering the the outer peripheral surface of the shaft body 20, restricts the shaft body 20. The insert member 5, with the through-hole 53 covering the outer peripheral surface of the shaft body 20, restricts the shaft body 20.

It therefore follows that the lower end 21 of the shaft body 20 is restricted to a degree equivalent to the axis-directional lengths of the use-for-shaft recessed portion 63 of the shaft securing member 6 and of the engaging member 4 when the engaging member 4 is fitted to the protruded portion 67 of the shaft securing member 6. While on the other hand, when the insert member 5 is fitted to the shaft body 20, it follows that the lower end 21 of the shaft body 20 is restricted in the axial direction to a degree equivalent to the axis-directional length of the insert member 5. According to the third embodiment, the axis-directional length of the portion to restrict the shaft body 20 can be therefore adjusted by attaching and detaching the insert member 5. In other words, according to the third embodiment, a first adjusting mechanism capable of adjusting the axis-directional length to restrict the shaft 2 is configured to include the engaging member 4, the insert member 5 and the shaft securing member 6.

The insert member 5 is splitable into two insert segments in the peripheral direction as illustrated in FIG. 17B. More specifically, the cylindrical insert member 5 having the cylindrical shape is configured by combining two insert segments 50 each taking a circular arc in section. Note that the insert segments 50 may also be configured to be secured together. For example, one insert segment 50 is provided with a protruded portion, while the other insert segment 50 is provided with a recessed portion, and the protruded portion may engage with the recessed portion. Alternatively, one insert segment 50 is provided with a key way, while the other insert segment 50 is provided with a key, and the key may engage with the key way. A method for securing the two insert segments 50 together may be, without being limited in particular, properly selected corresponding to the embodiment. Note that a specific method for attaching and detaching the insert member 5 will be described later on.

Note that the materials of the engaging member 4, the insert member 5 and the shaft securing member 6 may be properly selected corresponding to the embodiment. For example, the metals, the resins, the FRP and other equivalent materials may also be used. The securing member 104 may be configured to serve as an ornament member generally called the socket, the ferrule or the feral and other equivalent members.

3. Shaft Length Extension Mechanism (Second Adjusting Mechanism)

Figure 18:
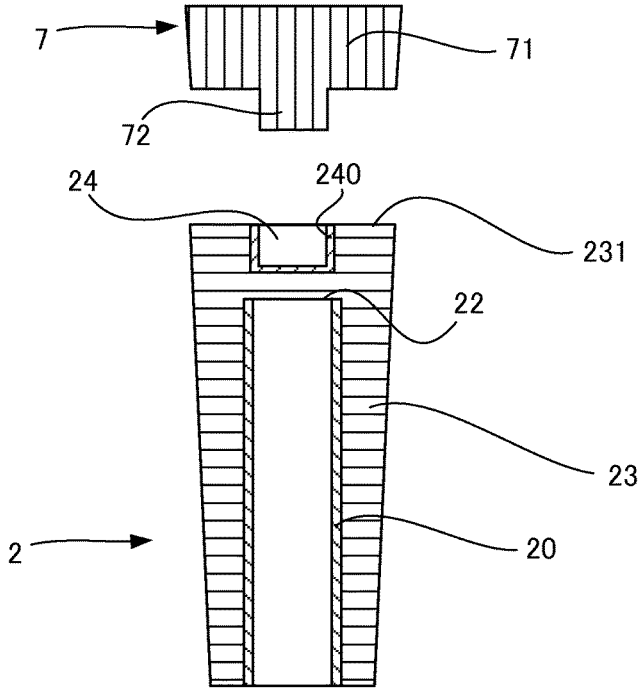
FIG. 18 is a sectional view schematically illustrating an extension member according to the third embodiment.

Next, a shaft length extension mechanism (second adjusting mechanism) according to the third embodiment will next be described with reference to FIG. 18. FIG. 18 is a sectional view schematically illustrating the extension member 7 and the rear end portion of the shaft 2 according to the third embodiment. As illustrated in FIG. 18, the grip end 231 of the shaft 2 is provided with a cylindrical recessed portion 24. An inner peripheral surface of the recessed portion 24 may be, as depicted in FIG. 18, coated with a coating member 240 composed of a resin, a metal and other equivalent materials that have higher hardness than the grip 23. An inner peripheral surface of the coating member may be formed with a female thread.

On the other hand, the extension member 7 includes a body portion 71 and a protruded portion 72 sequentially from the upper end thereof. The body portion 71 is configured to have substantially the same outside diameter as an outside diameter of the grip 23 in the vicinity of the grip end 231 so that the shaft 2 is continuous to an external shape of the extension member 7 when fitting the extension member 7 to the grip end 231 of the shaft 2. The protruded portion 72 is formed in the cylindrical shape corresponding to the recessed portion 24 of the shaft 2. An outer peripheral surface of the protruded portion 72 is formed with a male thread screwed to a female thread of the recessed portion 24. Note that a material of the extension member 7 may be properly selected corresponding to the embodiment. For instance, the extension member 7 may be composed of a rubber, a resin and other equivalent materials. An outer peripheral surface of the protruded portion 72 may be coated with the resin, the metal and other equivalent materials that have higher hardness than the material of the extension member 7 as in the case of the recessed portion 24.

According to the third embodiment, the extension member 7 can be fitted to the grip end 231 of the shaft 2 by causing the protruded portion 72 (male thread) of the extension member 7 to be screwed to the recessed portion 24 (female thread) of the shaft 2. With this contrivance, the axis-directional length of the shaft 2 increases corresponding to the axis-directional length of the extension member 7 (body portion 71). According to the third embodiment, the axis-directional length of the shaft 2 can be adjusted by attaching and detaching the extension member 7. The second adjusting mechanism capable of adjusting the axis-directional length of the shaft 2 is configured by the extension member 7 according to the third embodiment. Note that the shaft 2 and the extension member 7 are configured to be detachably attachable to each other through the male thread and the female thread thereof in the third embodiment. However, the attaching/detaching mechanism for the shaft 2 and the extension member 7 may be, without being limited to the example given above, properly selected corresponding to the embodiment.

4. Usage Method

Figure 19:
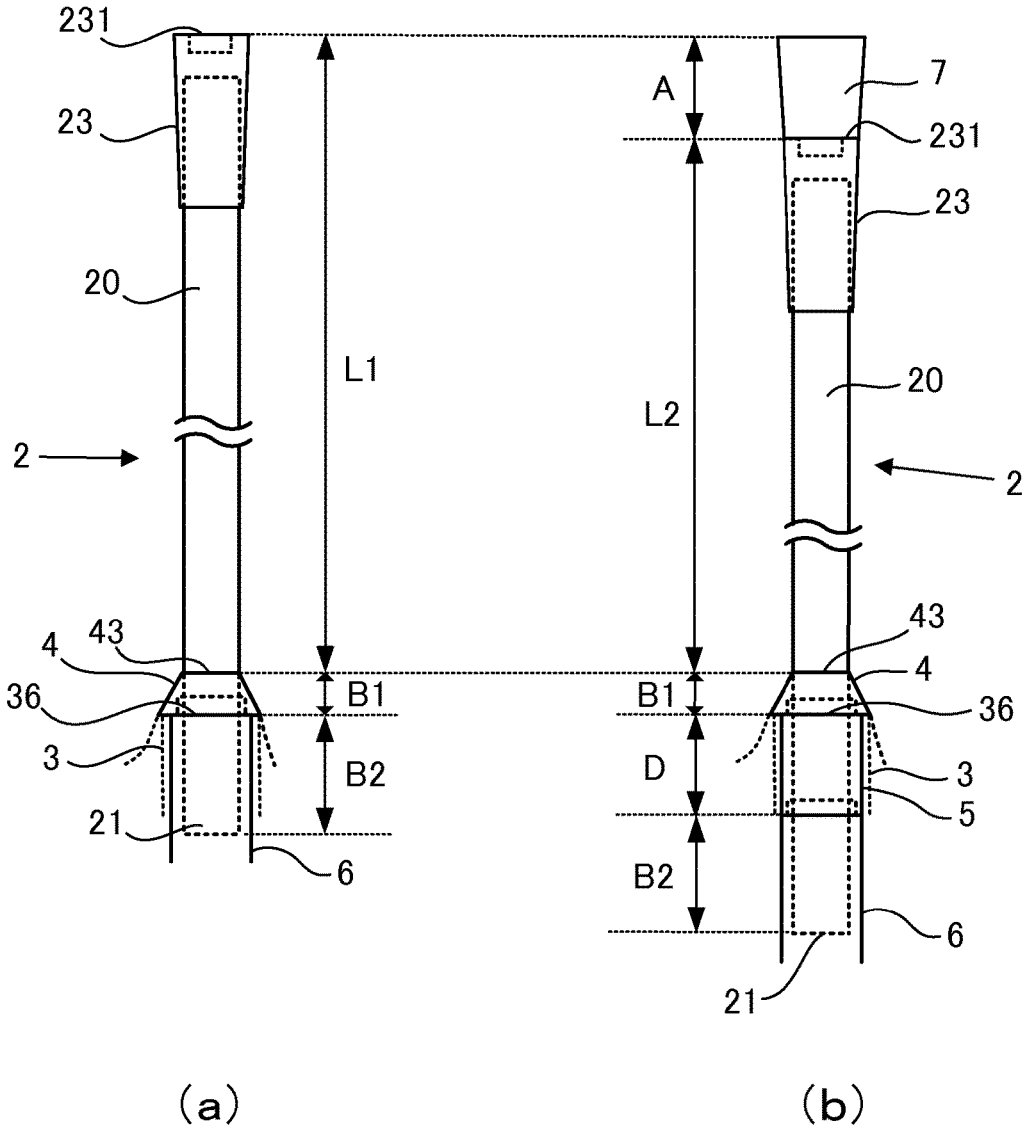
FIG. 19 is a diagram illustrating a comparative example of a club length of the golf club in two modes according to the third embodiment.

A usage method of each adjusting mechanism configured as described above will next be described with reference to FIG. 19. The first adjusting mechanism according to the third embodiment can take the first mode in which the engaging member 4 is fitted directly to the shaft securing member 6. In other words, the first adjusting mechanism can take the first mode of not fitting the insert member 5. And the first adjusting mechanism can take the second mode of disposing the insert member 5 between the shaft securing member 6 and the engaging member 4. Similarly, the second adjusting mechanism according to the third embodiment can take the first mode in which the extension member 7 is not fitted to the grip end 231 of the shaft 2. In other words, the second adjusting mechanism can take the first mode of removing the extension member 7 from the grip end 231 of the shaft 2. And the second adjusting mechanism can take the second mode of fitting the extension member 7 to the grip end 231 of the shaft 2. FIG. 19 illustrates a comparative example of the club length between the two adjusting mechanisms in the two modes, i.e., the first mode and the second mode, respectively.

Both of the first adjusting mechanism and the second adjusting mechanism take the first mode in FIG. 19(*a*). In the first mode, the engaging member 4 is secured to the shaft securing member 6. Herein, the engaging member 4 is inserted into the shaft body 20, and the shaft securing member 6 is secured to the lower end 21 of the shaft body 20. The engaging member 4 can be therefore secured to the shaft securing member 6 by causing the recessed portion 42 of the engaging member 4 to be screwed to the protruded portion 67 of the shaft securing member 6 while moving the engaging member 4 along the shaft body 20. In the first mode, when the extension member 7 is fitted to the grip end 231 of the shaft 2, the extension member 7 is removed from the grip end 231 of the shaft 2.

In this state, a portion (length B1+length B2) on the side of the lower end 21, which is restricted by the engaging member 4 and the shaft securing member 6, does not cause the flexure when the user swings the club. Hence, a range (length L1) from the upper end 43 (neck end surface) of the engaging member 4 to the grip end 231 of the shaft 2 becomes a range in which to cause the flexure when the user swings the club, i.e., a range involved in the flexure of the shaft 2. Concretely, any flexure is caused neither in a portion existing more upward than the upper end 22 of the shaft body 20 nor in a portion gripped by the user. Consequently, when the user swings the club by gripping the grip 23 of the golf club 10, the flexure is caused in a range covering the upper end 43 of the engaging member 4 through the end of the area gripped by the user in the shaft 2.

Subsequently, the second mode illustrated in FIG. 19(*b*) will be described. A shift to the second mode from the first mode in the first adjusting mechanism involves, at first, removing the engaging member 4 from the shaft securing member 6. Next, the engaging member 4 is moved along the shaft body 20 to separate from the shaft securing member 6. Then, as illustrated in FIG. 19(*b*), the insert member 5 is fitted to the shaft body 20.

Herein, in order to fit the insert member 5 to the shaft body 20, at first, the insert member 5 is assembled by combining the couple of insert segments 50 along the outer periphery of the shaft body 20 to take the cylindrical shape. Hereat, the axial-directional position to dispose the two insert segments 50 exists between the shaft securing member 6 and the engaging member 4. Subsequently, the recessed portion 54 (female thread) of the insert member 5 on the side of the lower end 56 is screwed to the protruded portion 67 (male thread) of the shaft securing member 6. The insert member 5 and the shaft securing member 6 are thereby secured together. Finally, the recessed portion 42 (female thread) of the engaging member 4 is screwed to the protruded portion 51 (male thread) of the insert member 5 on the side of the upper end 55. Upon this operation, the first adjusting mechanism shifts to the second mode.

A shift to the second mode from the first mode in the second adjusting mechanism involves fitting the extension member 7 to the grip end 231 of the shaft 2. The extension member 7 can be fitted to the grip end 231 of the shaft 2 by causing the recessed portion 24 (female thread) formed in the grip end 231 of the shaft 2 to be screwed to the protruded portion 72 (male thread) of the extension member 7.

In this state, a depth at which the shaft 2 (shaft body 20) is inserted into the hosel 3 increases to a degree corresponding to the fitted area of the insert member 5 (length D). Consequently, a length L2 from the upper end 43 of the engaging member 4 to the grip end 231 of the shaft 2 is shorter by D than the length L1 in the first mode. In other words, when fitting the insert member 5, the club length decreases to a degree corresponding to the length D of the insert member 5.

Such being the case, in the third embodiment the axis-directional length of the shaft 2 is extended by fitting the extension member 7 to the grip end 231 of the shaft 2. Concretely, a length A is equalized to the length D so that the axis-directional length A of the extension member 7 corresponds to the axis-directional length D of the insert member 5, thereby enabling the length from the upper end 43 of the engaging member 4 to the end of the shaft 2 on the side of the grip end 231 to be kept constant in the first mode and the second mode. When the length from the upper end 43 of the engaging member 4 to the end of the shaft 2 on the side of the grip end 231 remains the same, the neck length and a size of the head 1 remain the same, resulting in the club length being the same. According to the third embodiment, the club length can be therefore kept constant by making use of the extension member 7 having the length corresponding to the length of the insert member 5.

In this state, a portion (B1+B2+D) on the side of the lower end 21, which is restricted by the engaging member 4 and the shaft securing member 6, does not cause the flexure when the user swings the club. In other words, as compared with the first mode, the portion not causing the flexure upon the user's swinging the club augments corresponding to the axis-directional length D of the insert member 5 at the front end portion of the shaft 2. However, the length A of the extension member 7 fitted to the grip end 231 of the shaft 2 is the same as the length D of the insert member 5. Supposing that the user grips the same range extending from the rear end portion of the shaft 2, the length of the portion involved in the flexure of the shaft 2 therefore remains constant in the first mode and the second mode.

However, even when the length of the portion involved in the flexure of the shaft 2 therefore is kept constant, the deflectability of the shaft 2 varies for the following reason. The shaft 2 is configured, based on a configuring method thereof, to vary flexural rigidity from the front end portion to the rear end portion. Generally, the shaft body 20 is configured to have more deflectability on the side of the lower end 21 than on the side of the upper end 22. As illustrated in FIG. 19, when making a comparison between the first mode and the second mode, the portion involved in the flexure of the shaft 2 keeps its length constant but shifts in the axial direction. Even when there is no variation in length of the portion involved in the flexure of the shaft 2, the front end portion and the rear end portion of the shaft 2 have different flexural rigidities, resulting in a variation in deflectability of the shaft 2. According to the third embodiment, the deflectability of the shaft 2 can be varied by varying the length of the restriction range at the front end portion of the shaft 2. Concretely, the golf club 10 according to the second mode becomes harder to bend to a degree corresponding to elongation of the restriction range at the front end portion of the shaft 2 than in the first mode.

The portion not causing the flexure when swinging the club augments in the second mode as compared with the first mode, and, however, there is no variation in neck length (B1) from the upper end 36 of the hosel to the upper end of the engaging member 4. The third embodiment therefore enables the variation in deflectability of the shaft 2 without varying the neck length.

As discussed above, the third embodiment therefore enables the variation in deflectability of the shaft 2 without varying the neck length and the club length. It is therefore feasible to vary the deflectability of the shaft 2 without causing the user to feel any discomfort derived from the variations in neck length and club length. Note that plural types of insert members 5 having different axis-directional lengths may be prepared without being limited to one type. Plural types of extension members 7 having different axis-directional lengths may also be prepared corresponding to the arrangement described above. The deflectability of the shaft 2 can be thereby varied stepwise.

Note that even when selecting the first mode in which an insertion length into the internal space of the hosel 3 is substantially reduced, the second cylindrical portion 62 of the shaft securing member 6 is configured to reach the second diametral portion 33 of the hosel 3. Hence, even in this case, the shaft securing member 6 can be joined to the hosel 3 to be unrotatable in the periaxial direction by causing the plurality of protrusion lines 621 formed on the second cylindrical portion 62 of the shaft securing member 6 to engage with the plurality of groove lines formed in the second diametral portion 33 of the hosel 3. In this instance, the thread portion 92 of the fixture 9 inserted from the lower end 37 is configured to be screwed to the female thread of the use-for-fixture recessed portion 64 of the shaft securing member 6. Consequently, the shaft 2 and the head 1 can be properly secured together.

Further, even when selecting the second mode in which the insertion length into the internal space of the hosel 3 is substantially increased, the lower end 66 of the shaft securing member 6 is configured not to reach the lower end of the second diametral portion 33 of the hosel 3. In this case, the end surface 611 between the first cylindrical portion 61 and the second cylindrical portion 62 of the shaft securing member 6 is configured not to reach the stepped portion between the first diametral portion 32 and the second diametral portion 33 of the hosel 3. Consequently, even when selecting the second mode in which the insertion length into the internal space of the hosel 3 is substantially increased, an overall portion existing below from the lower end 44 (the end surface 441) of the engaging member 4 is received in the internal space of the hosel 3.

One aspect of the third embodiment aims at providing the golf club capable of varying the deflectability of the shaft without varying the neck length. According to the third embodiment, as described above, it is feasible to provide the golf club capable of varying the deflectability of the shaft without varying the neck length.

5. Modified Example

The embodiments of the present invention have been described so far. However, the descriptions stated above are merely the exemplifications of the present invention in every respect. It is a matter of course that a variety of improvements and modifications can be made without deviating from the scope of the present invention. For example, the components of the golf club 10 may be properly omitted, replaced and added corresponding to the embodiments. The shapes and the sizes of the components of the golf club 10 may also be set corresponding to the embodiments. For instance, the following modifications can be made. Note that the same numerals and symbols as those in the third embodiment are assigned to the components, having the same configurations, of the modified examples to be described below as the components of the third embodiment for the convenience of explanation. The same contents as in the third embodiment are adequately omitted.

<5.1>

The first adjusting mechanism in the third embodiment adjusts the axis-directional length to restrict the shaft 2 in the mode (the second mode) of using the insert member 5 and the mode (the first mode) of not using the insert member 5. The adjusting method of the first adjusting mechanism may not, however, be limited to this example. For example, the axis-directional length to restrict the shaft 2 may be adjusted by using the plurality of insert members 5 having the different axis-directional lengths. An example of using the two insert members (5A, 5B) will hereinafter be described with reference to FIG. 20. However, the number of the insert members 5 may be equal to or larger than "3" without being limited to "2". Note that the two insert members (5A, 5B) are configured the same as the insert member 5 according to the third embodiment except a difference of the axis-directional length of the body portion 52.

Figure 20:
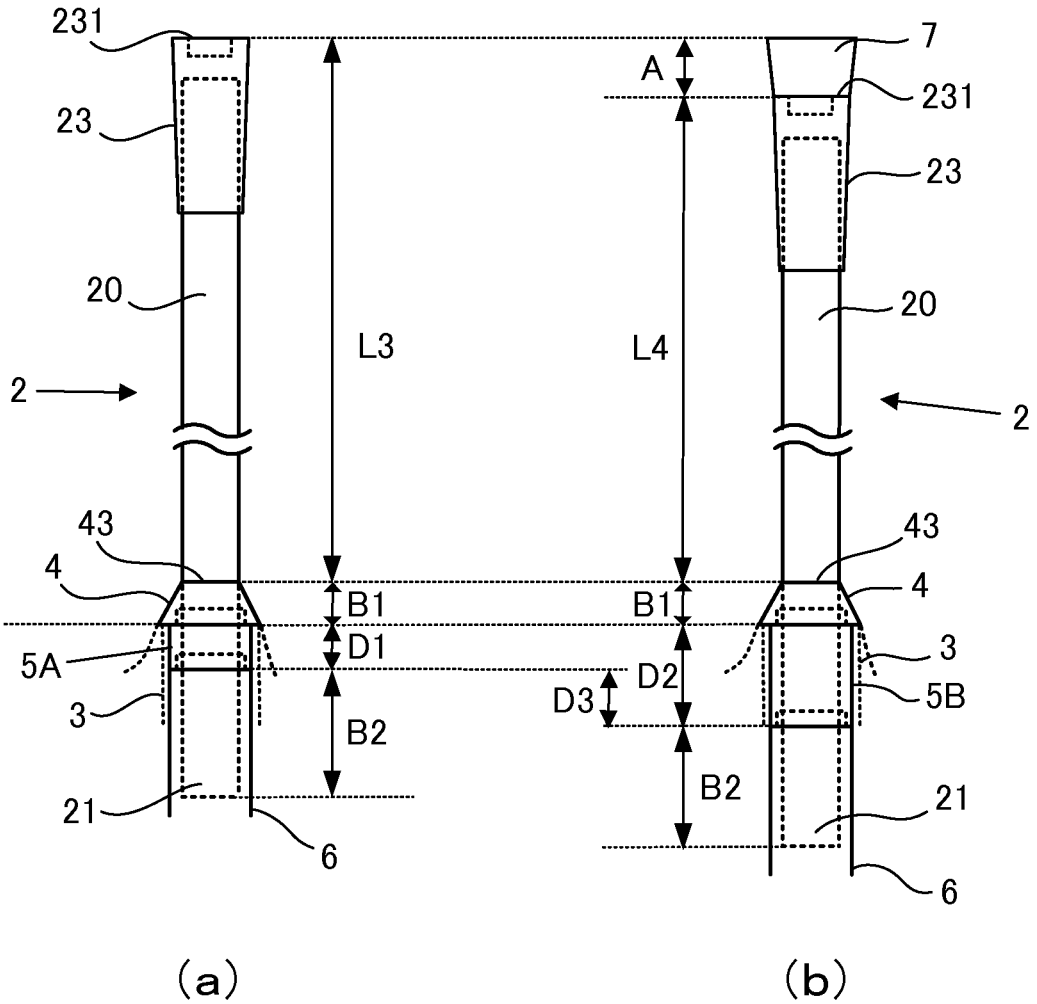
FIG. 20 is a diagram illustrating a comparative example of the club length of the golf club in the two modes according to a modified example.

FIG. 20 illustrates a comparative example of the club length in two modes according to the present modified example. In this case, the first adjusting mechanism according to the modified example can adopt a first mode of fitting the insert member 5A (length D1) having a substantially short axis-directional length and a second mode of fitting the insert member 5B (length D2) having a substantially long axis-directional length.

In FIG. 20(*a*), both of the first adjusting mechanism and the second adjusting mechanism take the first mode. In order for the first adjusting mechanism to take the first mode, it may be sufficient that the insert member 5A having the substantially short axis-directional length is fitted to the shaft body 20 by the fitting method described above. In this state of the shaft 2, a range (length L3) from the upper end 43 of the engaging member 4 to the grip end 231 of the shaft 2 becomes a range in which to cause the flexure upon the user's swinging the club, i.e., a range involved in the flexure of the shaft 2.

On the other hand, in FIG. 20(*b*), both of the first adjusting mechanism and the second adjusting mechanism take the second mode. In order for the first adjusting mechanism to shift to the second mode from the first mode, it may be sufficient that the insert member 5A having the substantially short axis-directional length is removed from the shaft 2, while the insert member 5B having the substantially long axis-directional length is fitted to the shaft body 20. In this state of the shaft 2, a length L4 of a portion ranging from the upper end 43 of the engaging member 4 to the grip end 231 of the shaft 2 is shorter by a difference D3 between an axis-directional length D1 of the insert member 5A and an axis-directional length D2 of the insert member 5B than the length L3 in the first mode. While on the other hand, with the extension member 7 being fitted to the grip end 231 of the shaft 2, the axis-directional length of the shaft 2 becomes longer by the axis-directional length A of the extension member 7. The club length can be therefore kept constant in the first mode and the second mode by equalizing the length A to the difference D3 so that the axis-directional length A of the extension member 7 corresponds to the difference D3 of the axis-directional length between the two insert members (5A, 5B) in the third embodiment.

The length A of the extension member 7 is herein the same as the difference D3 between the two insert members (5A, 5B), and hence the length of the portion involved in the flexure in the first mode is the same as the length in the second mode. However, based on the same principle as in the third embodiment, the golf club 10 according to the second mode is harder to bend than in the first mode because of the length of the restricted portion of the lower end 21 of the shaft body 20 being longer by D3. Note that the neck length is kept constant in the first mode and the second mode on the basis of the same principle as in the third embodiment.

<5.2>

In the third embodiment, the second adjusting mechanism adjusts the axis-directional length of the shaft 2 in the mode (second mode) of using the extension member 7 and in the mode (first mode) of not using the extension member 7. The adjusting method of the second adjusting mechanism may not, however, be limited to the example given above. For instance, the axis-directional length of the shaft 2 may be adjusted by using the plurality of extension members 7 having the different axis-directional lengths. An example of using two extension members (7A, 7B) will hereinafter be described with reference to FIGS. 21 and 22. However, the number of the extension members 7 may be equal to or larger than "3" without being limited to "2". Note that the two extension members (7A, 7B) are configured the same as the extension member 7 according to the third embodiment except a difference of the axis-directional length of the body portion 71.

Figure 21:
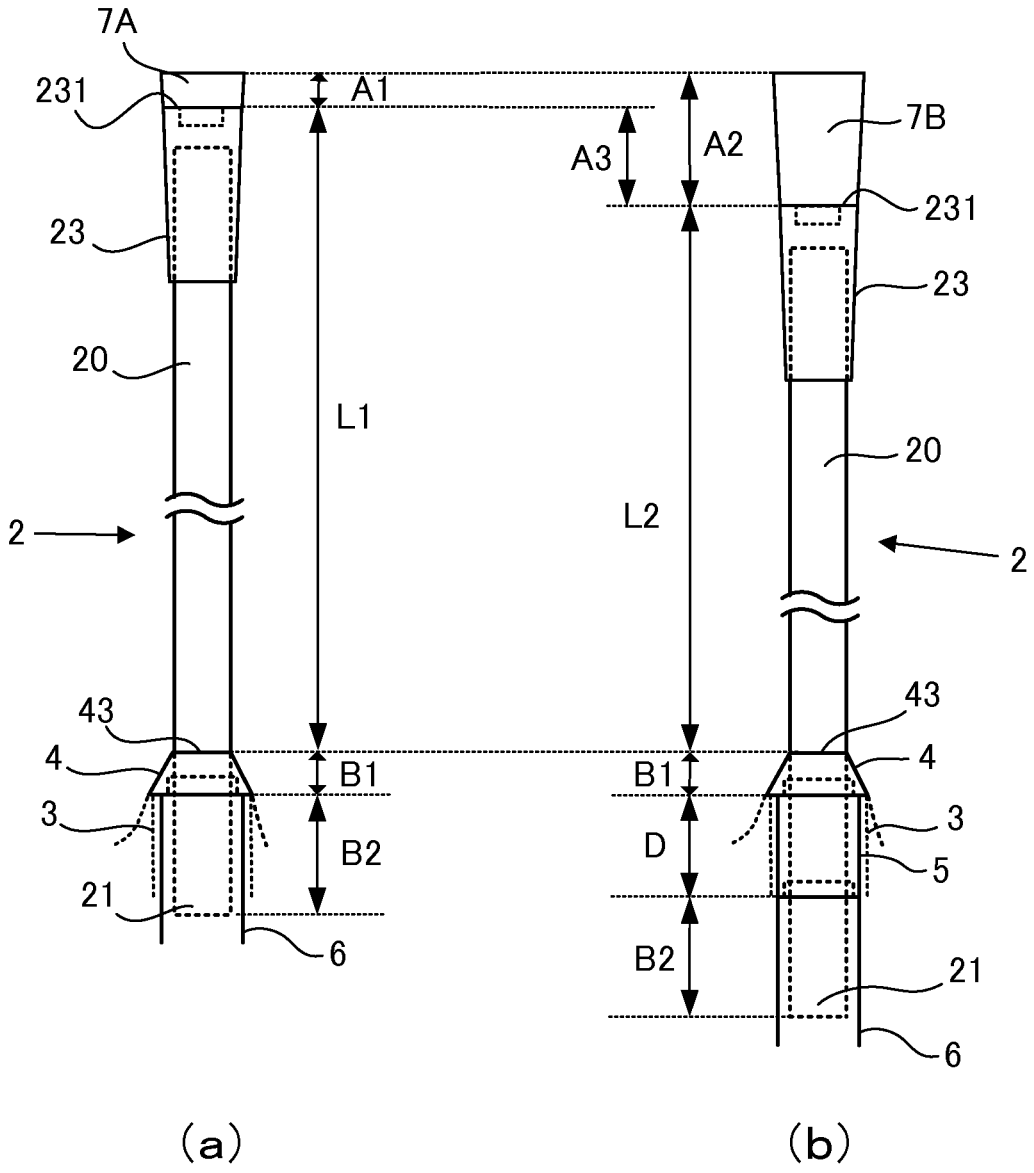
FIG. 21 is a diagram illustrating a comparative example of the club length of the golf club in the two modes according to the modified example.
Figure 22:
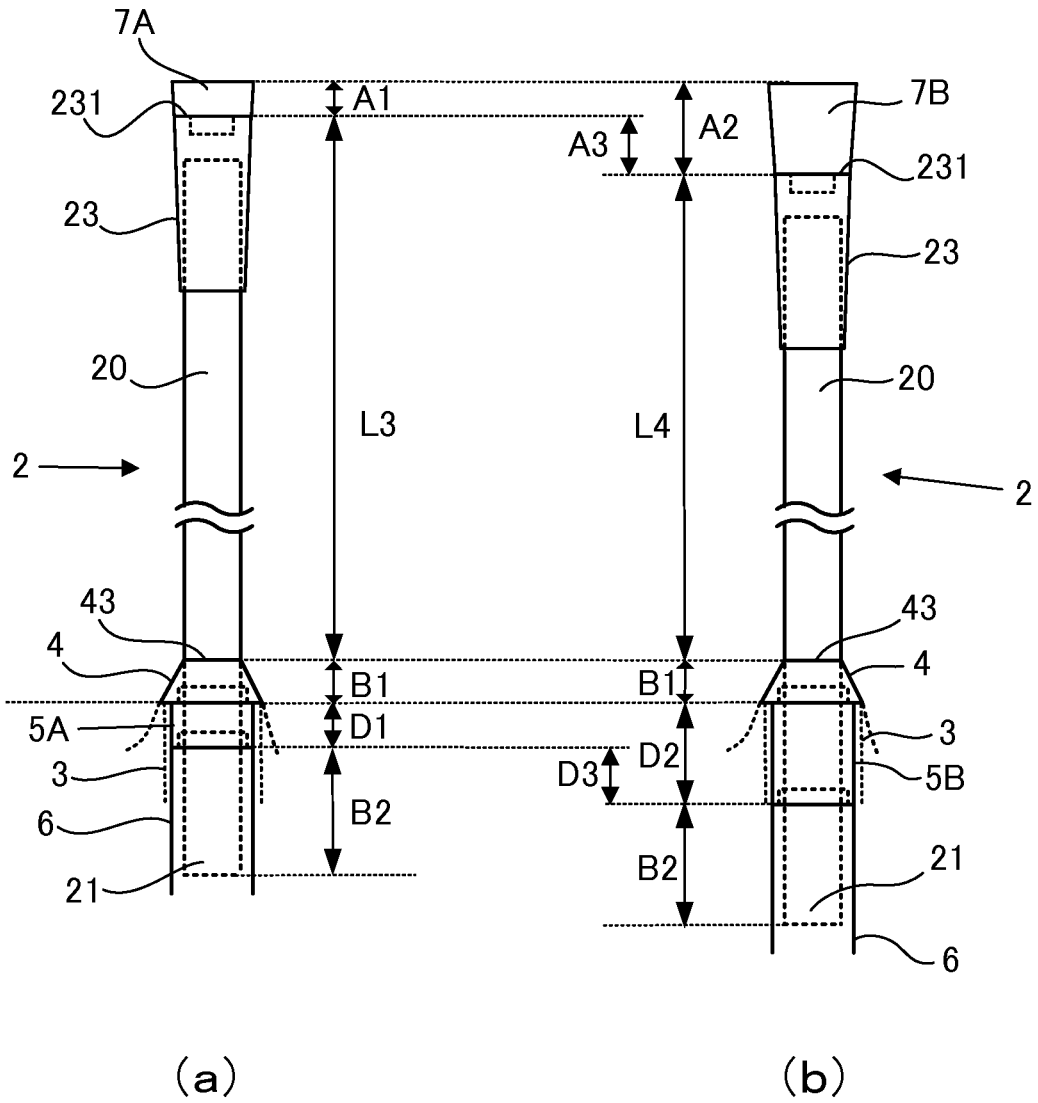
FIG. 22 is a diagram illustrating a comparative example of the club length of the golf club in the two modes according to the modified example.

Irrespective of the adjusting method of the second adjusting mechanism, any one of the method in the third embodiment and the method in the modified example <5.1> may be herein adopted as an adjusting method of the first adjusting mechanism. FIG. 21 illustrates an example that the first adjusting mechanism adopts the same method as in the third embodiment. On the other hand, FIG. 22 illustrates an example that the first adjusting mechanism adopts the method of the modified example <5.1>.

Described at first is an example that the first adjusting mechanism adopts the same method as in the third embodiment. FIG. 21 depicts a comparative example of the club length in the two modes according to the modified example. In this instance, the second adjusting mechanism according to the modified example can take the first mode of fitting the extension member 7A (length A1) having the substantially short axis-directional length and the second mode of fitting the extension member 7B (length A2) having the substantially long axis-directional length.

In FIG. 21(*a*), both of the first adjusting mechanism and the second adjusting mechanism take the first mode. In order for the second adjusting mechanism to take the first mode, it may be sufficient that the extension member 7A having the substantially short axis-directional length is fitted to the grip end 231 of the shaft 2 by the fitting method described above. In this state, a length from the upper end 43 of the engaging member 4 to an edge of the grip end 231 of the shaft 2 becomes a length (L1+A1). Note that the range to cause the flexure upon the user's swinging the club is, similarly to the third embodiment, the range (length L1) from the upper end 43 of the engaging member 4 to the grip end 231 of the shaft 2.

While in FIG. 21(*b*), both of the first adjusting mechanism and the second adjusting mechanism take the second mode.

In order for the second adjusting mechanism to shift to the second mode from the first mode, it may be sufficient that the extension member 7A having the substantially short axis-directional length is removed from the grip end 231 of the shaft 2, while the extension member 7B having the substantially long axis-directional length is fitted to the grip end 231 of the shaft 2. In this state of the shaft 2, a length L2 of a portion ranging from the upper end 43 of the engaging member 4 to the grip end 231 of the shaft 2 is shorter by an axis-directional length D of the insert member 5 than the length L1 in the first mode. While on the other hand, the extension member 7 having the substantially long axis-directional length is fitted to the grip end 231 of the shaft 2, whereby the axis-directional length of the shaft 2 becomes longer by a difference A3 between the length A1 of the extension member 7A and the length A2 of the extension member 7B than in the first mode. The club length can be therefore kept constant in the first mode and the second mode by equalizing the difference A3 to the length D so that the difference A3 of the axis-directional length between the two extension members (7A, 7B) corresponds to the axis-directional length D of the insert member 5 in the third embodiment.

The length D of the insert member 5 is the same as the difference A3 between the two extension members 7 (7A, 7B), and hence the length of the portion involved in the flexure in the first mode is the same as the length in the second mode. However, based on the same principle as in the third embodiment, the golf club 10 according to the second mode is harder to bend than in the first mode because of the length of the restricted portion of the lower end 21 of the shaft body 20 being longer by D. Note that the neck length is kept constant in the first mode and the second mode in this modified example on the basis of the same principle as in the third embodiment.

Described next is an example that the first adjusting mechanism adopts the same method as in the modified example <5.1>. FIG. 22 depicts a comparative example of the club length in the two modes according to the modified example.

In FIG. 22(*a*), both of the first adjusting mechanism and the second adjusting mechanism take the first mode. In this state, a length from the upper end 43 of the engaging member 4 to an edge of the grip end 231 of the shaft 2 becomes a length (L3+A1). Note that the range to cause the flexure upon the user's swinging the club is, similarly to the modified example <5.1>, a range given by excluding the grip 23 from the portion (length L3) from the upper end 43 of the engaging member 4 to the grip end 231 of the shaft 2.

While in FIG. 22(*b*), both of the first adjusting mechanism and the second adjusting mechanism take the second mode. In this state of the shaft 2, a length L4 of a portion ranging from the upper end 43 of the engaging member 4 to the grip end 231 of the shaft 2 is shorter by the difference D3 between the axis-directional length D1 of the insert member 5A and the axis-directional length D2 of the insert member 5B than the length L3 in the first mode. While on the other hand, the extension member 7 having the substantially long axis-directional length is fitted to the grip end 231 of the shaft 2, whereby the axis-directional length of the shaft 2 becomes longer by a difference A3 between the length A1 of the extension member 7A and the length A2 of the extension member 7B than in the first mode. The club length can be therefore kept constant in the first mode and the second mode by equalizing the difference A3 to the difference D3 so that the difference A3 of the axis-directional length between the two extension members (7A, 7B) corresponds to the difference D3 of the axis-directional length between the two insert members (5A, 5B) in the third embodiment.

The difference D3 between the two insert members (5A, 5B) is the same as the difference A3 between the two extension members 7 (7A, 7B), and hence the length of the portion involved in the flexure in the first mode is the same as the length in the second mode. However, based on the same principle as in the third embodiment, the golf club 10 according to the second mode is harder to bend than in the first mode because of the length of the restricted portion of the lower end 21 of the shaft body 20 being longer by D3. Note that the neck length is kept constant in the first mode and the second mode in this modified example on the basis of the same principle as in the third embodiment.

<5.3>

In the third embodiment, the engaging member 4, the insert member 5 and the shaft securing member 6 are secured by the threads. The relation between the male thread (protruded portion) and the female thread (recessed portion) may, however, be reversed. For example, each of FIGS. 23, 24A and 24B illustrates an example of replacing the protruded portion and the recessed portion with each other between the insert member 5 and the shaft securing member 6.

Figure 23:
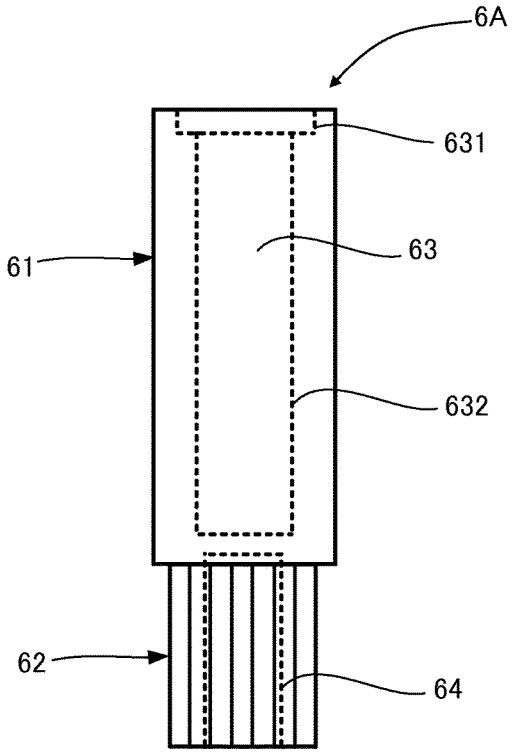
FIG. 23 is a front view schematically illustrating the shaft securing member according to the modified example.

FIG. 23 illustrates a shaft securing member 6A according to the modified example. FIGS. 24A and 24B illustrate an insert member 5C according to the modified example. As depicted in FIG. 23, the shaft securing member 6A according to the modified example includes a recessed portion 631 formed in the upper end of the use-for-shaft recessed portion 63. The recessed portion 631 is larger in inside diameter than an area 632 on the side of the lower end. The inner peripheral surface of the recessed portion 631 is formed with the female thread.

Figure 24A:
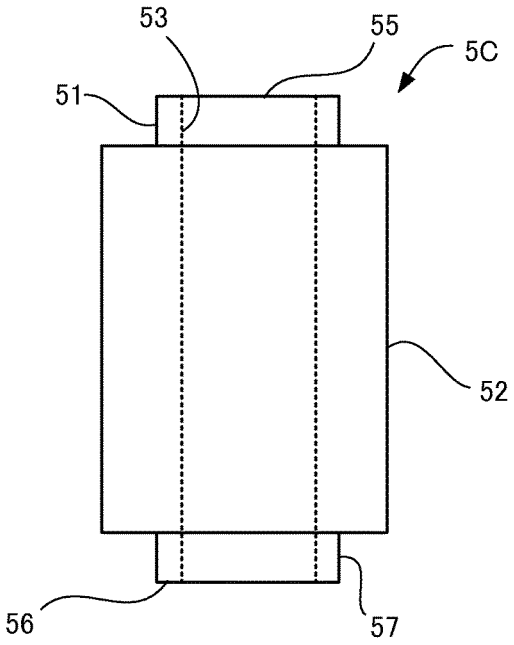
FIG. 24A is a diagram schematically illustrating the insert member (the cylindrical state) according to the modified example.
Figure 24B:
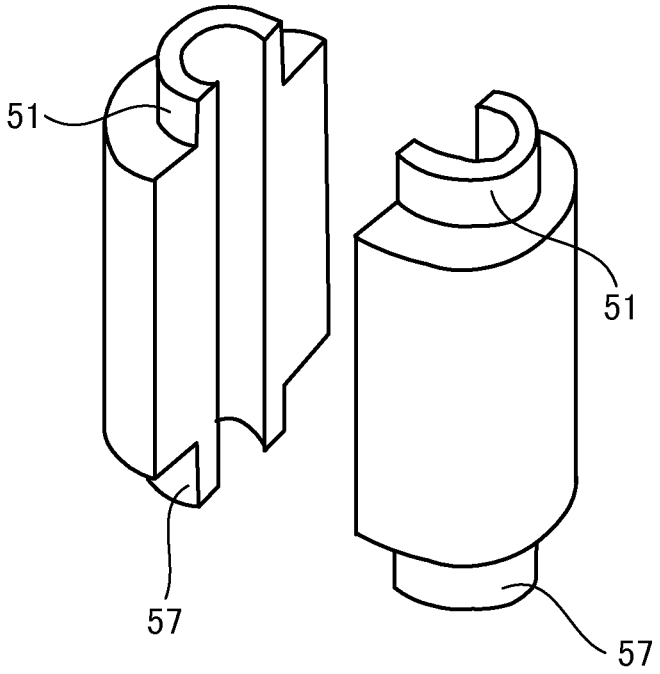
FIG. 24B is a perspective view schematically illustrating the insert member (the split state) according to the modified example.

On the other hand, as illustrated in FIGS. 24A and 24B, the insert member 5C according to the modified example is formed with a protruded portion 57 protruding downward in the axial direction on the side of the lower end 56. An outside diameter of the protruded portion 57 is set corresponding to an inside diameter of the recessed portion 631. An outer peripheral surface of the protruded portion 57 is formed with the male thread screwed to the female thread formed in the recessed portion 631. With this configuration, the insert member 5C can be fitted to the shaft securing member 6A by causing the protruded portion 57 (male thread) of the insert member 5C to be screwed to the recessed portion 631 (female thread) of the shaft securing member 6A. The protruded portion and the recessed portion may be replaced with each other between the respective members.

<5.4>

In the third embodiment, the engaging member 4, the insert member 5 and the shaft securing member 6 are secured by the threads and can be also secured otherwise than the threads. The method of securing the members may be, if configured to secure the members detachably, properly selected corresponding to the embodiment. For example, as illustrated in FIG. 25, a snap fitting mechanism may also be provided.

Figure 25:
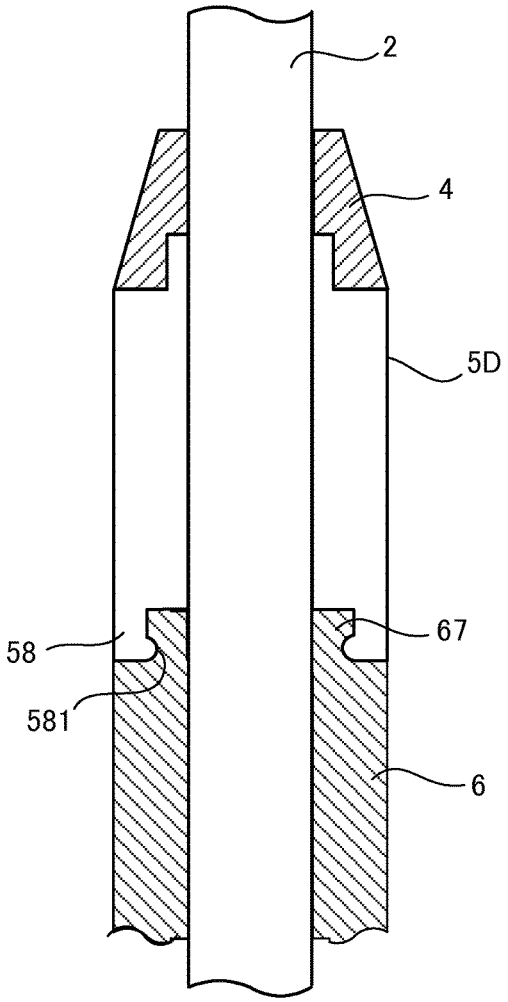
FIG. 25 is a diagram illustrating a method of securing the insert member and the shaft securing member according to the modified example.

FIG. 25 illustrates an example of using the snap fitting mechanism between the insert member 5D and the shaft securing member 6. In FIG. 25, the lower end of the insert member 5D is provided with an annular protrusion 58 to pinch the protruded portion 67 of the shaft securing member 6 from outside in the radial direction. An inner peripheral surface of the protrusion 58 is provided with a come-off preventive protrusion piece 581 engaging with the protruded portion 67 of the shaft securing member 6. This protrusion piece 581 is composed of an elastically deformable material. With this contrivance, the insert member 5D can be secured not by the threads. This mechanism may also be used for securing the engaging member and the insert member together.

<5.5>

In the third embodiment, the extension member 7 is integrally formed. However, the structure of the extension member 7 may be, without being limited to this example, properly selected corresponding to the embodiment. For instance, as depicted in FIG. 26, the extension member 7 may also be configured by combining different members.

Figure 26:
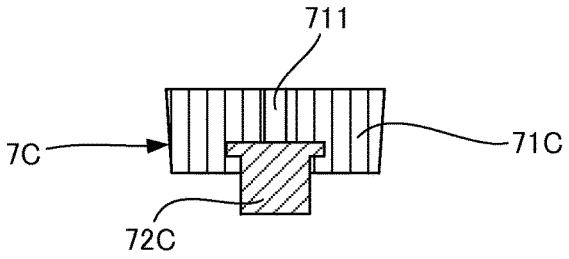
FIG. 26 is a diagram illustrating the extension member according to the modified example.

FIG. 26 illustrates an extension member 7C according to the modified example. As illustrated in FIG. 26, the extension member 7C, a body portion 71C and a protruded portion 72C may be built up members different from each other. Herein, the body portion 71C may be composed of, e.g., a substantially soft material instanced by a rubber, a resin and other equivalent materials. The protruded portion 72C may also be composed of a harder material instanced by a metal, a resin and other equivalent materials than the body portion 71C. Note that the body portion 71C of the extension member 7C illustrated in FIG. 26 is formed with an insertion hole 711 receiving insertion of a wrench instanced by a hexagonal wrench and other equivalent wrenches. In the case of fitting this extension member 7C to the shaft 2, the user inserts the wrench, at first, into the insertion hole 711, and further inserts the wrench into a polygonal recessed portion (unillustrated) formed in the upper end of the protruded portion 72C, the recessed portion being instanced by a hexagonal recessed portion and other equivalent portions. Then, the user can fit the extension member 7C to the shaft 2 by operating the wrench.

<5.6>

In the third embodiment, the extension member 7 is fitted to the grip end 231 of the shaft 2 by causing the protruded portion 72 (male thread) of the extension member 7 to be screwed to the recessed portion 24 (female thread) formed in the grip end 231 of the shaft 2. However, the structure of fitting the extension member 7 to the shaft 2 may be, without being limited to the example given above, properly selected corresponding to the embodiment. The following discussion will illustrate two modified examples of fitting the extension member 7 to the shaft 2.

Figure 27A:
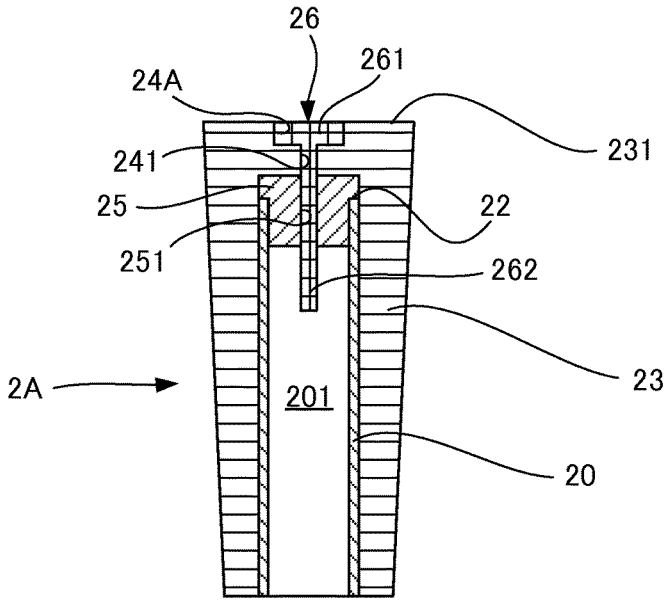
FIG. 27A is a diagram illustrating a modified example of a mechanism to fit the extension member to the shaft (a state of removing the extension member)
Figure 27B:
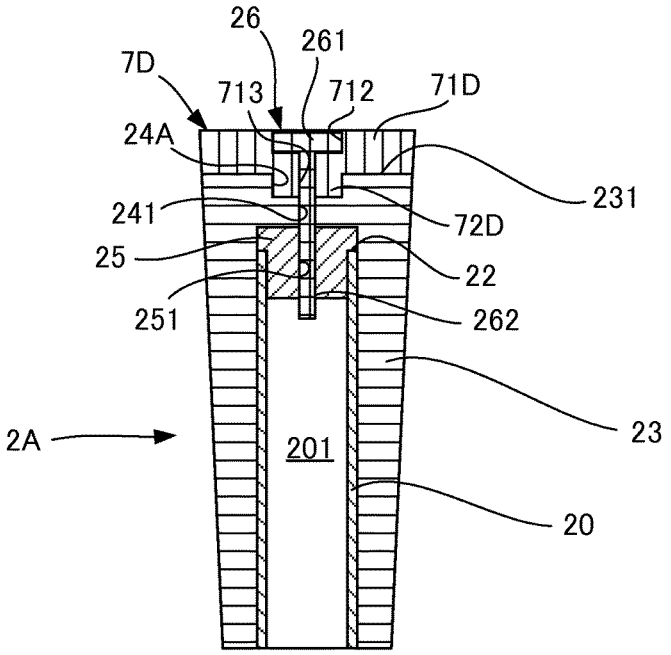
FIG. 27B is a diagram illustrating the modified example of the mechanism to fit the extension member to the shaft (a state of fitting the extension member).

To begin with, FIGS. 27A and 27B depict an example of fitting an extension member 7D to a shaft 2A by use of a fixture 26. FIG. 27A depicts a rear end portion of the shaft 2A in a state of not being fitted with the extension member 7D. FIG. 27B depicts the rear end portion of the shaft 2A in a state of being fitted with the extension member 7D.

In the shaft 2A depicted in FIGS. 27A and 27B, a fitting member 25 fits to the upper end 22 of the shaft body 20. The fitting member 25 includes a through-hole 251 penetrating an interior in the vertical direction. An inner peripheral surface of the through-hole 251 is formed with a female thread screwed to a screw portion 262 (male thread) of the fixture 26 that will be described later on. Note that the fitting member 25 is composed of, e.g., a metal, a resin and other equivalent materials.

The gip 23 covers the upper end 22 of the shaft body 20 together with the fitting member 25. The grip end 231 of the grip 23 is formed with a recessed portion 24A matching with a shape of a head portion 261 of the after-mentioned fixture 26. A through-hole 241 penetrating an interior in the vertical direction communicates with the recessed portion 24A. The grip end 231 therefore communicates with a hollowed portion of the grip 23 via the recessed portion 24A and the through-hole 241.

By contrast, the fixture 26 includes a cylindrical head portion 261 and a cylindrical screw portion 262 that is smaller in diameter than the head portion 261. An outer peripheral surface of the screw portion 262 is formed with a male thread screwed to a female thread formed in an inner peripheral surface of the through-hole 251 of the fitting member 25. Consequently, in the state of not being fitted with the extension member 7D, the fixture 26 is inserted into the through-hole 241 till the head portion 261 of the fixture 26 is fitted in the recessed portion 24A of the grip end 231. The screw portion 262 of the fixture 26 can be thus screwed to the through-hole 251 of the fitting member 25. As illustrated in FIG. 27A, the fixture 26 can be thereby fitted to the grip end 231.

The extension member 7D is formed with a through-hole penetrating an interior in the vertical direction along a body portion 71D and a protruded portion 72D. This through-hole includes a large-diametral portion 712 having the same diameter as the recessed portion 24A of the shaft 2, and a small-diametral portion 713 having the same diameter as the through-hole 241 of the recessed portion 24A. The protruded portion 72D is configured to have the same diameter as the head portion 261 of the fixture 26. The protruded portion 72D of the extension member 7D can be therefore inserted into the recessed portion 24A of the grip end 231. Then, the screw portion 262 of the fixture 26 is inserted into the small-diametral portion 713 of the extension member 7D till the head portion 261 of the fixture 26 is fitted in the large-diametral portion 712 of the extension member 7D, thereby enabling the screw portion 262 of the fixture 26 to be screwed to the through-hole 251 of the fitting member 25. As illustrated in FIG. 27B, the extension member 7D can be thereby fitted to the shaft 2.

Note that as illustrated in FIGS. 27A and 27B, the screw portion 262 of the fixture 26 is configured to reach the cylindrical hollowed portion 201 of the shaft body 20 irrespective of whether to be fitted to the extension member 7D in this modified example. With this configuration it is feasible to adequately ensure a length at which the screw portion 262 (male thread) of the fixture 26 is screwed to the female thread of the fitting member 25.

Figure 28A:
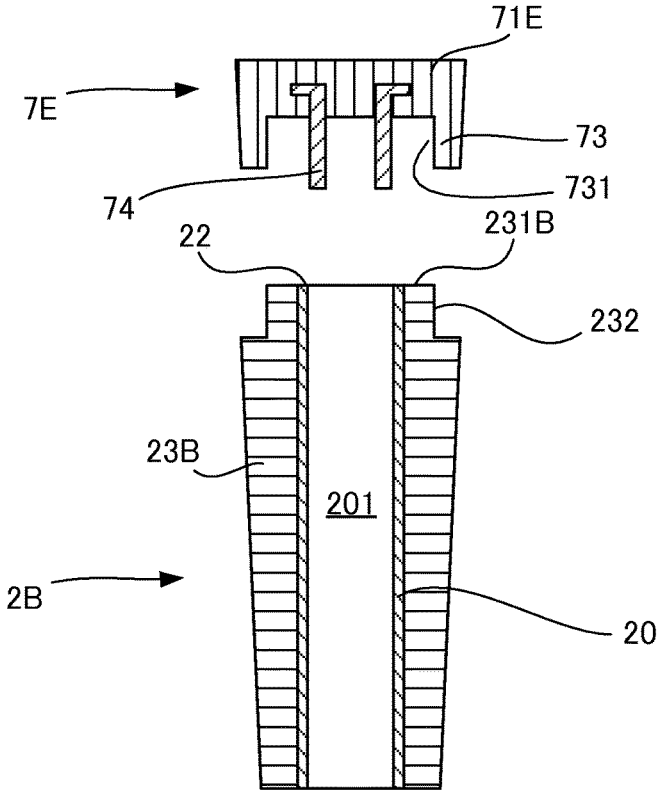
FIG. 28A is a diagram illustrating the modified example of the mechanism to fit the extension member to the shaft.

FIG. 28A illustrates an example of forming a grip end 231B in a protruded shape and forming a lower end of an extension member 7E in a recessed shape. FIG. 28A depicts a rear end portion of the shaft 2B according to the modified example. In the shaft 2B depicted in FIG. 28A, the hollowed portion 201 of the shaft body 20 opens on the side of the grip end 231B. An annular external wall 232 surrounding the hollowed portion 201 from outward in the radial direction is provided from the grip end 231B over a predetermined area. An outside diameter of the external wall 232 is set smaller than an outside diameter of another area of the grip 23B, corresponding to an external annular portion 73 of the extension member 7E that will be described later on. Note that an outer peripheral surface of the external wall 232 may be formed with a male thread.

On the other hand, a lower end of the extension member 7E is provided with the external annular portion 73 (taking an annular shape and) extending in the axial direction, and an internal annular portion 74 (taking the annular shape and) disposed inwardly of the external annular portion 73. An inside diameter of an inner peripheral surface 731 of the external annular portion 73 is set corresponding to the outside diameter of the external wall 232 so that the external annular portion 73 can be fitted to the external wall 232 from outward in the radial direction. the internal annular portion 74 is longer in its axis-directional length than the external annular portion 73, and can be inserted into the hollowed portion 201. Note that as illustrated in FIG. 28A, the internal annular portion 74 may be constructed of a member different from a member building up the body portion 71E. In this case, the internal annular portion 74 involves using a harder material than the material of the body portion 71E. For example, the internal annular portion 74 is composed of a metal, a resin and other equivalent materials.

The extension member 7E can be therefore fitted to the shaft 2 by inserting the internal annular portion 74 of the extension member 7E into the hollowed portion 201 of the shaft 2, and fitting the external annular portion 73 of the extension member 7E to the external wall 232 formed on the grip end 231B. Concretely, the extension member 7E is fitted to the shaft 2 in such a state that the external wall 232 of the shaft 2B is pinched in between the internal annular portion 74 and the external annular portion 73 of the extension member 7E.

With this configuration, the present modified example can acquire the following effects. To be specific, according to the third embodiment, as illustrated in FIG. 18, when the extension member 7 is fitted to the shaft 2, a groove having a depth corresponding to a width (a length in a bilateral direction) of a stepped portion formed between the body portion 71 and the protruded portion 72 can be formed at a boundary between the extension member 7 and the shaft 2. By contrast, according to the modified example, the depth of the groove formed at the boundary between the extension member 7E and the shaft 2B is merely the width (the length in the bilateral direction) of the stepped portion formed between another area of the grip 23 and the external wall 232. The present modified example therefore can decrease the depth of the groove formed at the boundary between the extension member 7E and the shaft 2B, and can attain betterment in appearance of the portion to which the extension member 7E is fitted.

The shaft 2B being thus configured herein, the external wall 232 becomes a protrusion protruding upward on the side of the grip end 231B of the shaft 2B. It is therefore preferable that this fitting mechanism is used in the example <5.2> of selectively fitting one of the plurality of extension members 7E having the different axis-directional lengths to the grip end 231B of the shaft 2B.

It may be sufficient that the extension member 7 is configured to be detachably attachable to the shaft 2B, and the mechanism for securing the extension member 7E to the shaft 2B may be properly selected corresponding to the embodiment. For instance, the external wall 232 of the shaft 2B may be formed with a male thread, and the inner peripheral surface 731 of the external annular portion 73 of the extension member 7E may be formed with the female thread screwed to the male thread. With this configuration, the extension member 7E can be secured to the shaft 2B by causing the external wall 232 of the shaft 2B to be screwed to the external annular portion 73 of the extension member 7E. Similarly, an outer peripheral surface of the internal annular portion 74 of the extension member 7E may be formed with a male thread, and an inner peripheral surface of the grip end 231B of the shaft body 20 may also be formed with a female thread.

Figure 28B:
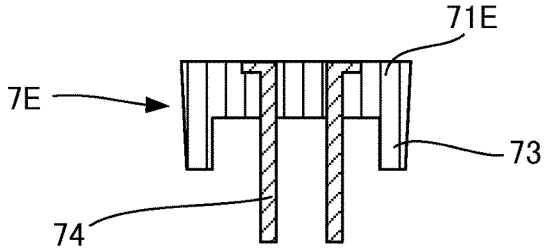
FIG. 28B is a diagram illustrating the extension member according to the modified example.

As depicted in FIG. 28B, a member building up the internal annular portion 74 of the extension member 7E may penetrate the extension member 7E in the vertical direction. FIG. 28B illustrates the extension member 7E according to the modified example. As described above, the internal annular portion 74 is composed of the harder material than the material of the body portion 71E. The extension member 7E can be made hard to deform by thus causing the penetration of the internal annular portion 74 in the vertical direction.

<5.7>

According to the third embodiment, the insert member 5 is configured to be split in the peripheral direction into the two insert segments. However, a splitable number of the insert member 5 may be equal to or larger than "3" without being limited to "2". In any case, the insert member 5 is configured to be splitable, in which case the outer peripheral surface of the assembly shaft body 20 can be covered from the radial direction without causing the insert member 5 to be inserted into the shaft body 20.

<5.8>

According to the third embodiment, the engaging member 4 is configured in the annular shape. However, the configuration of the engaging member 4 may not be limited to this example. For example, the engaging member 4 may be configured to be splitable as in the case of the insert member 5.

<5.9>

According to the third embodiment, the extension member 7 is configured by one member. The number of members configuring the extension member 7 may not, however, be limited to "1". One single extension member may also be configured by a plurality of members. For instance, the extension members 7 according to the third embodiment are enabled to join together and are dealt with as one member, whereby one single extension member can be configured by the plurality of members.

Note that a structure to join the extension members 7 together may be properly selected corresponding to the embodiment. For example, the plurality of extension members 7 can be joined together by providing the upper ends of the extension members 7 with the same recessed portions as the recessed portion 24 formed in the grip end 231 of the shaft 2. Thus, one single extension member may be configured by the plurality of members.

<5.10>

According to the third embodiment, the use-for-shaft recessed portion 63 is configured to extend along the axial line (the vertical direction in FIG. 15) of the shaft securing member 6. However, the shape of the use-for-shaft recessed portion 63 may be, without being limited to the example given above, properly selected corresponding to the embodiment. For instance, the use-for-shaft recessed portion 63 may be configured to extend obliquely from the axial line of the shaft securing member 6. This configuration enables the fixation of the axial center S (see FIGS. 11 and 2) of the shaft body 20 so as to extend obliquely from the axial line of the shaft securing member 6.

<5.11>

The golf club head 1 according to the third embodiment has the hollowed structure. The golf club head 1 may be therefore manufactured by joining two or more members. To be specific, the golf club head 1 may be manufactured by joining the head body formed with two or more apertures communicating with the hollowed portion to another member to seal the apertures. For instance, the crown 2 and the face 1 are constructed respectively of different members, and the head 1 can be configured by assembling the crown 2, the face 1 and the head body together. Further, the head 1 can be also configured by forming the head body including the aperture provided in the sole 3 or the side 4 and sealing this aperture with the different member. This head body can be manufactured by, e.g., known casting instanced by a lost wax precision casting process and other equivalent methods.

The invention claimed is:

1. A golf club comprising:

a shaft;

a golf club head including a hosel permanently fixed to a head having an aperture to which a front end portion of the shaft is secured by a bonding material;

a securing member configured in a cylindrical shape to cover an outer peripheral surface of the shaft, the securing member including a first securing portion detachably fitted to a peripheral edge of the aperture of the hosel; and an insert member configured in a cylindrical shape to cover the outer peripheral surface of the shaft, the insert member including a second securing portion being detachably attachable to the peripheral edge of the aperture of the hosel and a third securing portion being detachably attachable to the first securing portion of the securing member, wherein the golf club is capable of adopting a first mode of securing the first securing portion of the securing member to the hosel, and a second mode of securing the second securing portion of the insert member to the hosel and securing the first securing portion of the securing member to the third securing portion of the insert member.

2. The golf club according to claim 1, wherein the insert member is configured to enable adoption of a cylindrical state of covering the outer peripheral surface of the shaft and a split state of splitting the insert member into a plurality of insert segments in a peripheral direction to separate from the outer peripheral surface of the shaft.

3. The golf club according to claim 1, wherein the securing member is configured to be movable in an axial direction of the shaft, and the second mode is adopted by disposing the insert member between the peripheral edge of the aperture of the hosel and the securing member after moving the securing member in the axial direction along the shaft from the first mode.

4. The golf club according to claim 1, wherein a male thread is formed on an outer peripheral edge of the aperture of the hosel, the first securing portion of the securing member is formed with a female thread to be screwed to the male thread of the aperture of the hosel, the second securing portion of the insert member is formed with a female thread to be screwed to the male thread of the aperture of the hosel, and the third securing portion of the insert member is formed with a male thread to be screwed to the female thread of the first securing portion of the securing member.

5. The golf club according to claim 1, wherein an outer peripheral edge of the aperture of the hosel is formed with a male thread, and the first securing portion of the securing member includes:

a female thread to be screwed to the male thread of the aperture of the hosel; and an engaging portion to engage with an inner peripheral edge of the aperture of the hosel, the engaging portion being formed inward in a radial direction of the female thread.

6. The golf club according to claim 1, wherein the insert member is composed of a metal.

* * * * *